US012422214B1

(12) United States Patent
Maschin et al.

(10) Patent No.: US 12,422,214 B1
(45) Date of Patent: Sep. 23, 2025

(54) TOY LAUNCHING APPARATUS AND METHODS FOR DISCHARGING MULTIPLE PROJECTILE ROUNDS

(71) Applicant: Hasbro, Inc., Pawtucket, RI (US)

(72) Inventors: Robert C Maschin, Johnston, RI (US); Nicholas Alexander Tino, Seekonk, MA (US); David Drew Weiand, Johnston, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 18/440,341

(22) Filed: Feb. 13, 2024

Related U.S. Application Data

(60) Provisional application No. 63/445,841, filed on Feb. 15, 2023.

(51) Int. Cl.
*F41B 11/52* (2013.01)
*F41B 11/641* (2013.01)

(52) U.S. Cl.
CPC ..... *F41B 11/52* (2013.01); *F41B 11/641* (2013.01)

(58) Field of Classification Search
CPC ..... F41B 11/52; F41B 11/641; F41B 11/642
USPC ..... 124/59, 66, 67
See application file for complete search history.

(56) References Cited

U.S. PATENT DOCUMENTS 46,617 A 3/1865 Allen
159,609 A 2/1875 Prescott
956,760 A 5/1910 Moulin
1,441,975 A 1/1923 Edelin
1,488,995 A 4/1924 McCollom
1,743,576 A 1/1930 Smith
1,873,677 A 8/1932 Traver
2,214,224 A 9/1940 Douglas
2,483,752 A 10/1949 Buhl
2,634,717 A 4/1953 Junkin
2,725,868 A 12/1955 Foster
2,737,942 A 3/1956 Horowitz et al.
3,054,536 A 9/1962 Sagarin
3,262,440 A 7/1966 Kuhn
3,385,279 A 5/1968 Pitcher
3,420,133 A 1/1969 Proll
3,584,614 A 6/1971 Horvath
3,847,132 A 11/1974 Schatz
3,958,550 A * 5/1976 Johansson ..... F41B 11/647 124/40
3,990,426 A 11/1976 Stokes
4,094,294 A 6/1978 Speer
4,345,578 A 8/1982 Speer
4,597,527 A 7/1986 Sands
(Continued)

*Primary Examiner* — Bret Hayes
(74) *Attorney, Agent, or Firm* — Perry Hoffman

(57) ABSTRACT

A toy rounds blaster apparatus launching multiple projectile rounds with an energy source including a single launch spring for moving one or more pistons within one or more cylinders. A pressure distributor couples each of the one or more cylinders forward the one or more pistons, with an alignment system receiving a collection of the projectile rounds, for aligning individual projectile rounds between pressure distributor and the at least one barrel, with the pressure distributor coupling each of the one or more cylinders with a respective one of the individual projectile rounds. An actuator is linked with the energy source for causing the single launch spring of the energy source to move the one or more pistons and launch the projectile rounds.

20 Claims, 26 Drawing Sheets

(56) References Cited

U.S. PATENT DOCUMENTS 4,774,929 A 10/1988 Millman
4,841,945 A 6/1989 Braden
4,890,404 A 1/1990 Ferri
5,205,271 A 4/1993 Salva
5,244,153 A 9/1993 Kuhn et al.
5,267,549 A 12/1993 Webber
5,343,850 A 9/1994 Steer
5,471,967 A 12/1995 Matsuzaki et al.
5,522,374 A * 6/1996 Clayton ..... F41B 11/646 124/66
5,529,050 A 6/1996 D'Andrade
5,535,729 A 7/1996 Griffin et al.
5,704,150 A 1/1998 Millman
5,878,734 A 3/1999 Johnson et al.
6,119,671 A 9/2000 Smith et al.
6,460,530 B1 10/2002 Backeris et al.
6,488,019 B2 12/2002 Kotsiopoulos
7,051,727 B2 5/2006 Wu
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,371,282 B2 2/2013 Meggs et al.
8,387,605 B2 * 3/2013 Brown ..... F41B 7/08 124/66
8,397,705 B2 3/2013 DeHaan et al.
8,567,378 B2 10/2013 Nugent
8,640,683 B2 2/2014 Meggs et al.
8,671,926 B1 * 3/2014 Mahlstedt ..... F41B 11/89 124/65
8,695,579 B2 4/2014 Huebl
8,875,688 B2 11/2014 Nugent
9,097,476 B2 8/2015 Mead et al.
9,097,477 B1 8/2015 Mead et al.
9,389,042 B1 7/2016 Clayton
9,500,436 B2 11/2016 Macy
9,958,230 B1 5/2018 Nugent et al.
10,488,143 B2 11/2019 Victor et al.
10,488,148 B2 11/2019 Johnson et al.
10,823,527 B2 11/2020 Tino et al.
10,876,809 B1 12/2020 Kopman et al.
10,907,929 B2 2/2021 Bernal
11,519,689 B2 * 12/2022 Chia ..... F41A 3/76
2002/0166551 A1 11/2002 Lee
2007/0034197 A1 2/2007 Tschech
2009/0095272 A1 4/2009 Zimmerman
2009/0145412 A1 6/2009 Barish
2010/0206281 A1 8/2010 Kanitz et al.
2011/0220088 A1 * 9/2011 Maggiore ..... F41B 11/68 124/40
2013/0112184 A1 5/2013 Corsiglia et al.
2013/0146043 A1 6/2013 Zarecky et al.
2013/0312722 A1 11/2013 Price
2015/0002981 A1 * 1/2015 Klug ..... F41B 11/62 361/232
2016/0018184 A1 1/2016 Park

* cited by examiner

TOY LAUNCHING APPARATUS AND METHODS FOR DISCHARGING MULTIPLE PROJECTILE ROUNDS

CROSS-REFERENCE TO RELATED APPLICATION

This application claims priority pursuant to 35 U.S.C. 119 (e) to U.S. Provisional Application No. 63/445,841 filed on Feb. 15, 2023.

FIELD OF THE INVENTION

The present invention relates generally to a toy launching apparatus for discharging projectile rounds including multiple polymer beads or the like, and more particularly, for discharging plural projectile rounds simultaneously.

BACKGROUND OF THE INVENTION

Toy projectile launching devices are well known. A major marketer of such devices is Hasbro Inc., of Rhode Island, which sells such devices under the NERF® brand. The projectiles for such launching apparatus include soft foam darts of various designs and sizes, foam balls, also of various sizes, and other soft projectiles. The launching apparatus themselves come in various forms, including those simulating blasters, bows, rocket launchers, grenade launchers and foam car launchers.

Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, are stylized battery operated toy blasters that launches gel balls or 'gelfire' rounds.

SUMMARY OF THE INVENTION

In accordance with the present invention, an advantageous method and apparatus are provided in the form of a toy launch apparatus designed to discharge soft projectiles, with an advantageous method and system described with improved hopper and energy source allowing a single launch spring with multiple pistons and cylinders of a housing use a priming handle, the energy source, and a pressure distributor mounted for launching multiple projectiles.

Briefly summarized, the inventions relate to a toy launching apparatus capable of launching multiple projectiles employing an energy source. A pressure distributor couples forward with an alignment system receiving a collection of the projectiles, for aligning individual projectile rounds between pressure distributor and an at least one barrel, with the pressure distributor coupling each of the one or more cylinders with a respective one of the individual projectiles. An actuator is linked with the energy source for causing the launch spring of the energy source to move pistons and launch the projectile rounds.

BRIEF DESCRIPTION OF DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
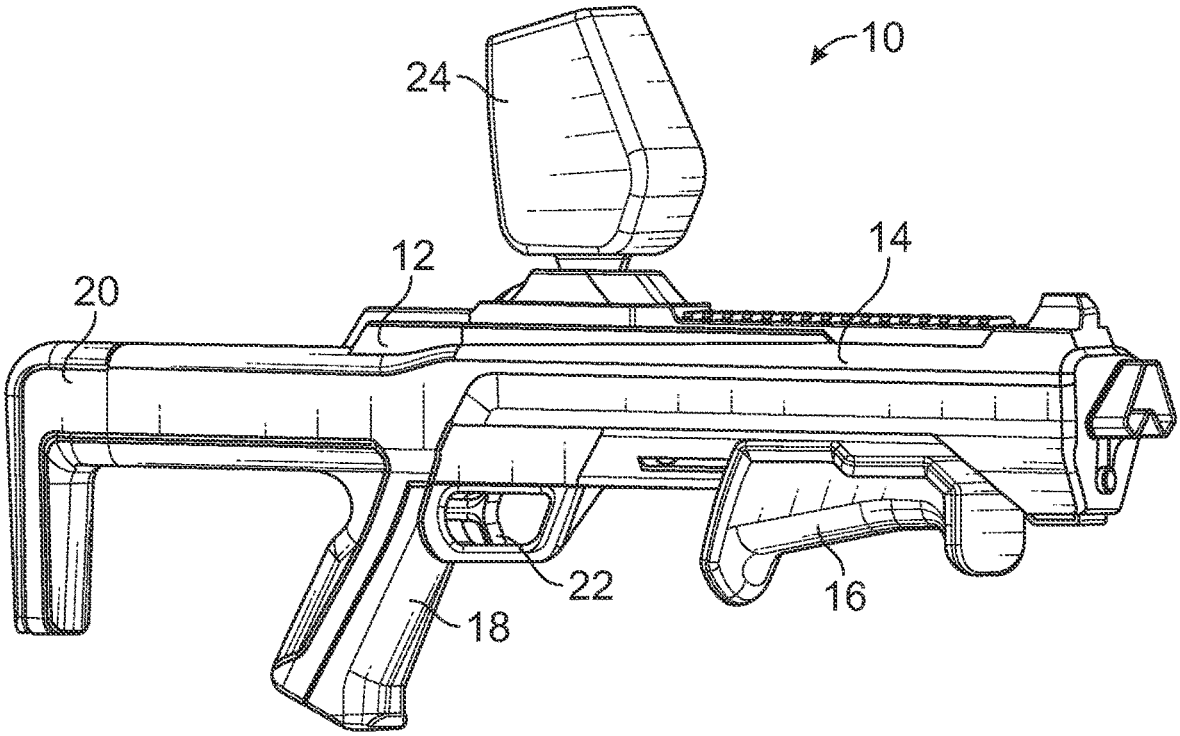
FIG. 1 is a front looking isometric view of a preferred embodiment of the present invention in the form of a toy blaster or launcher for simultaneously discharging multiple polymer beads, such as hydrated super absorbent polymer rounds.
Figure 2:
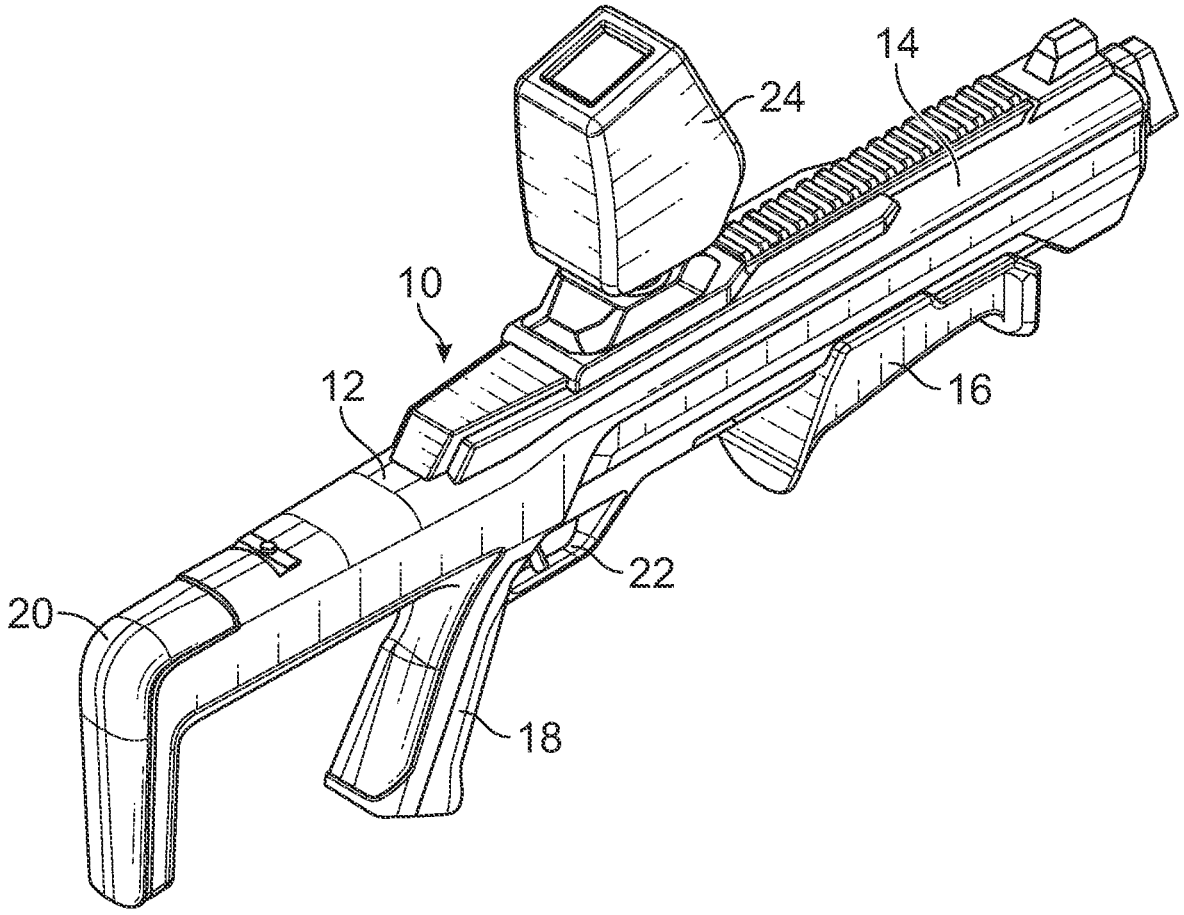
FIG. 2 is a rear looking isometric view the toy blaster shown in FIG. 1.

Referring first to FIGS. 1 and 2, there is illustrated a toy launching apparatus for simultaneously discharging multiple polymer beads, such as hydrated super absorbent polymer beads, hydrogel rounds and the like where the apparatus may take the form of a stylized toy blaster 10 having generally an outer shell or housing 12, a barrel portion 14 in a forward part of the toy blaster (to the right in FIGS. 1 and 2), a forearm or priming handle 16 located below the barrel portion 14, a grip portion 18, and a shoulder stock portion 20 in a rearward part of the toy blaster or launcher. The toy blaster 10 may also include a trigger assembly 22 forward of the grip portion 18, a removable magazine or hopper 24 as removeable or integrated in the alternative for storing hydrated super absorbent polymer beads and an energy source located within and mounted to the housing. While the toy launching apparatus may have the appearance of the stylized toy blaster as shown in the drawings, the apparatus may also resemble a buckshot toy, a scattershot launcher, or any other suitable toy launcher as exemplified by existing NERF® brand 'blasters.'

Figure 3:
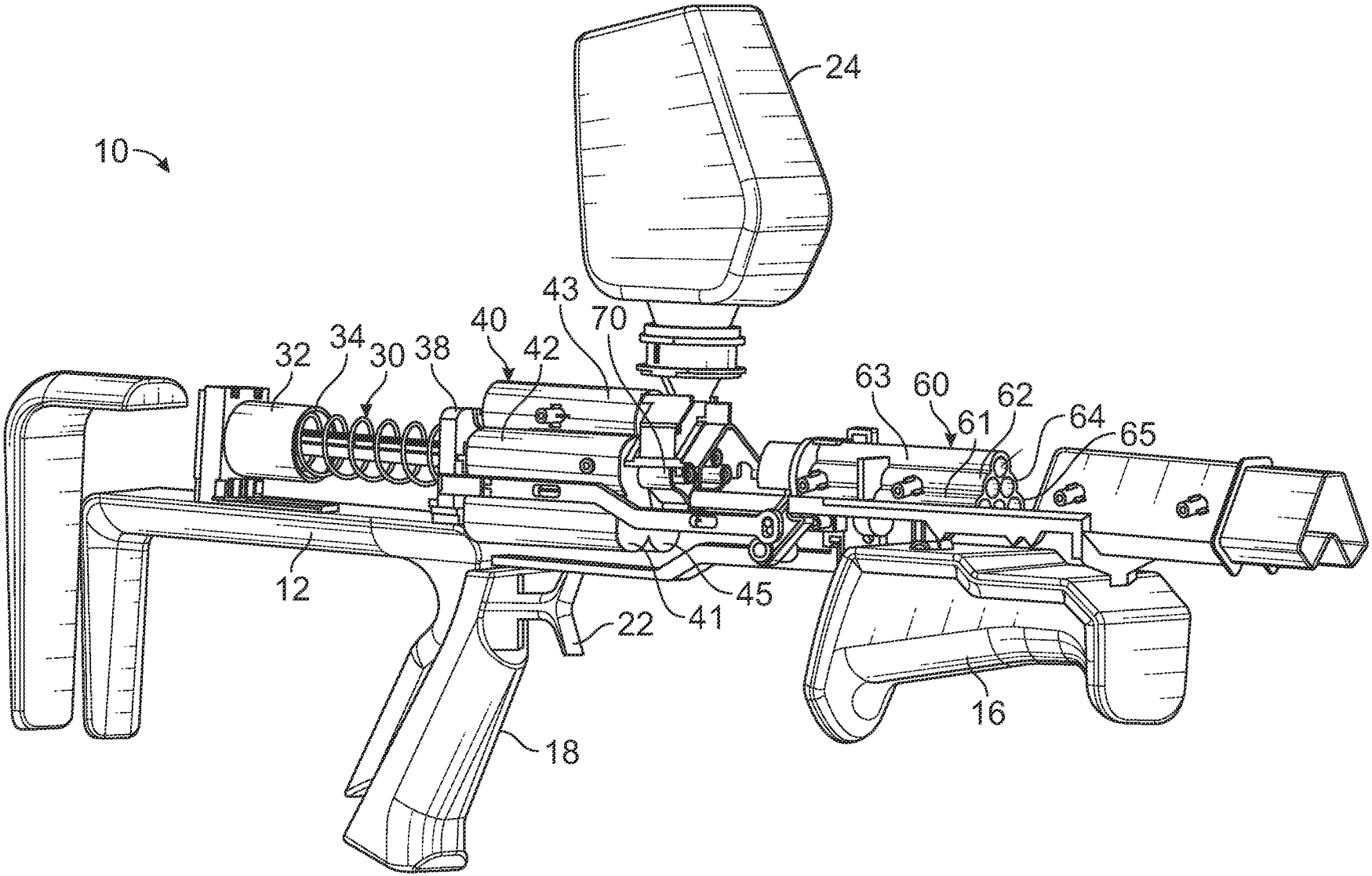
FIG. 3 is an isometric view of the toy blaster shown in FIGS. 1 and 2, with part of the housing removed.
Figure 4:
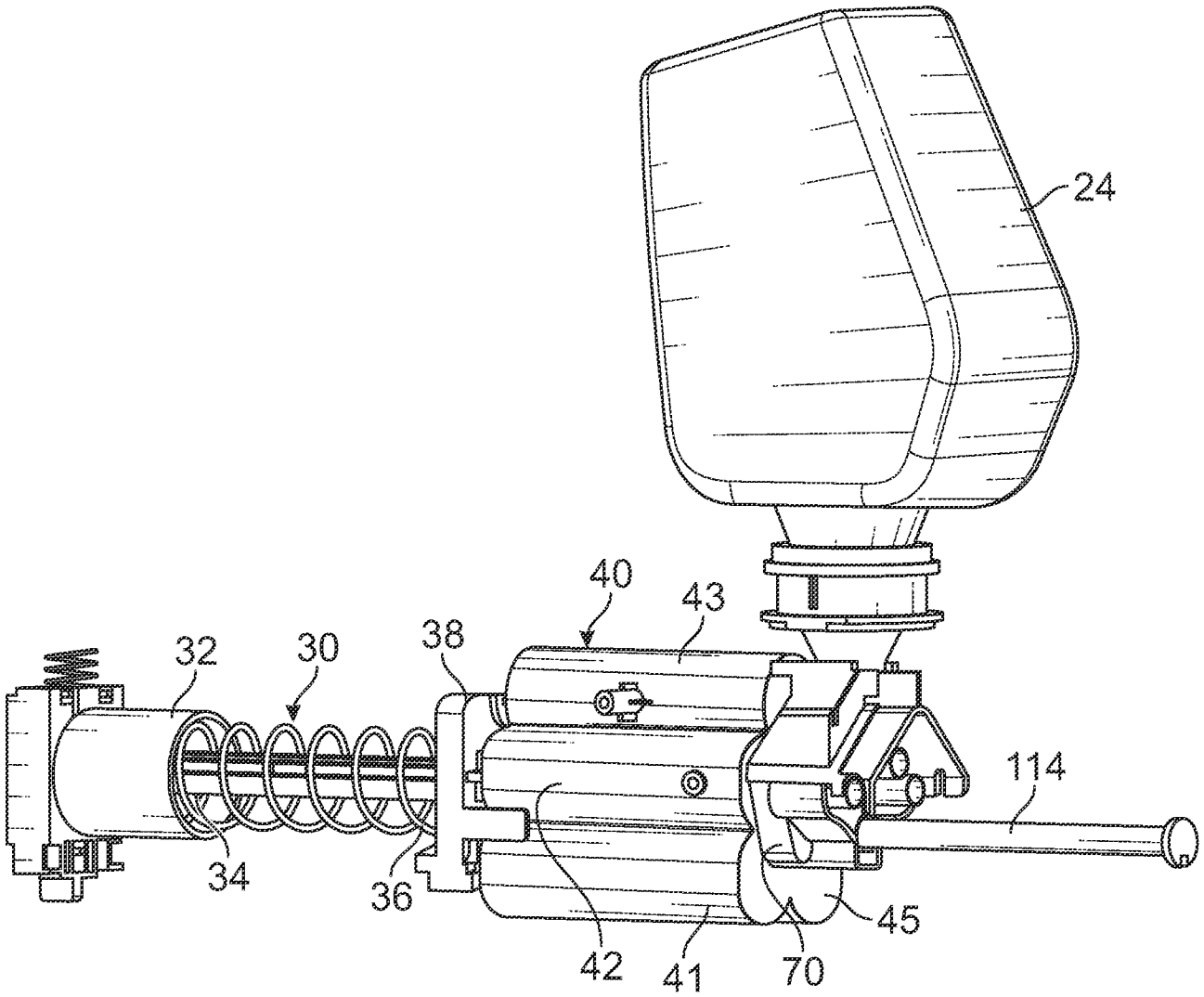
FIG. 4 is an enlarged side isometric view of a launch spring, an array of cylinders containing pistons, a pressure distributor and a bead alignment system of the toy blaster shown in FIGS. 1, 2 and 3.
Figure 5:
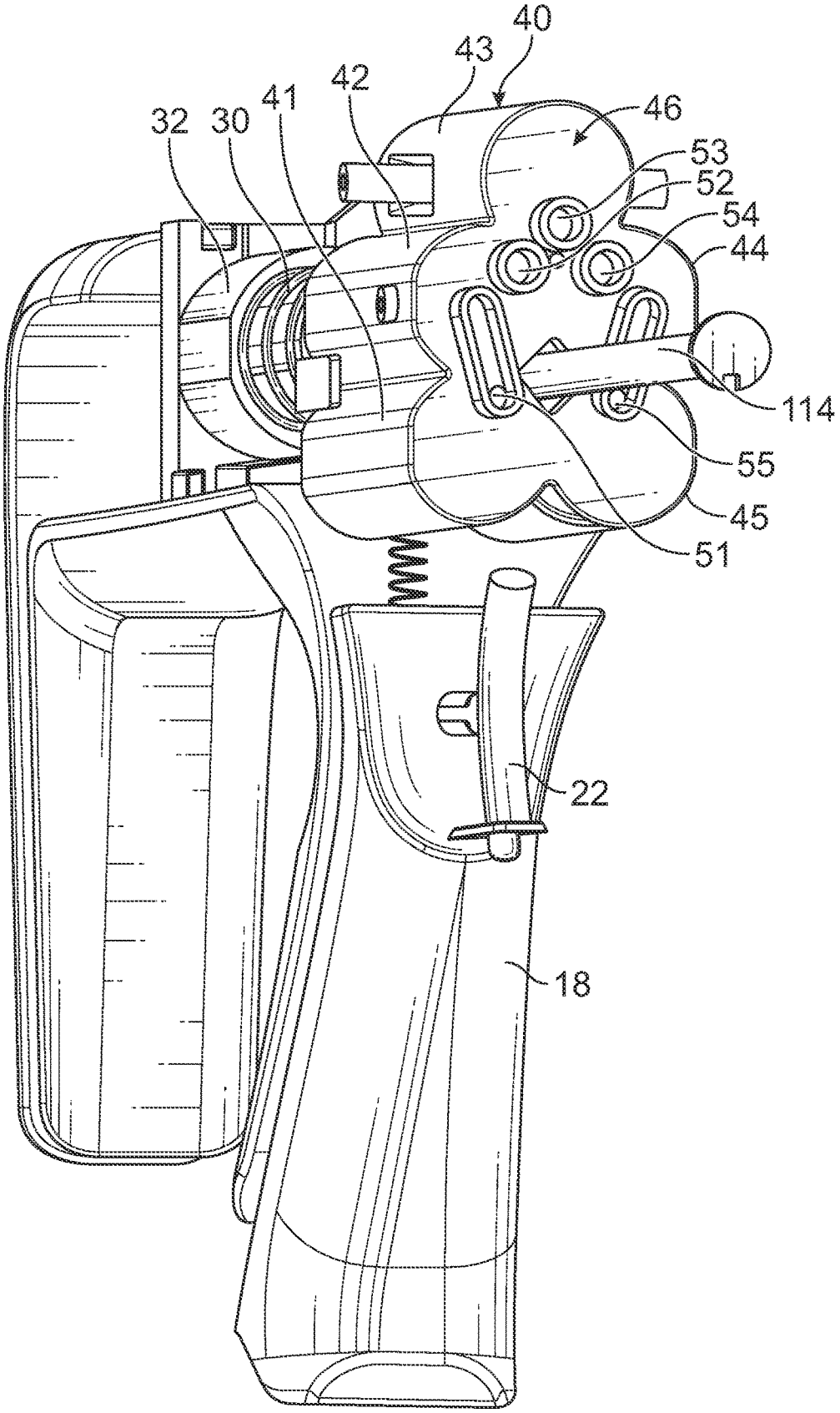
FIG. 5 is an enlarged front isometric view of the launch spring and the array of cylinders of the toy blaster shown in FIGS. 1-4.

Referring now to FIGS. 3-5, part of the housing has been removed to illustrate internal components mounted to the toy blaster 10, including an energy source in the form of a compressible launch spring 30, and a stationary spring seat 32, both mounted to the housing 12. One end 34 of the launch spring 30 is mounted in the spring seat 32 and the opposite end 36 of the launch spring bears against a slidable compression sled 38. Linked to the compression sled 38 is the priming handle 16 that an operator of the toy blaster may use to energize the toy blaster by compressing the launch spring 30. The described single launch spring 30 is advantageous as presently described, however multiple launch spring may be employed in the alternative. Mounted to the compression sled 38 is an cluster or array of cylinders and pistons 40; in the variation here, there are shown five cylinders 41, 42, 43, 44, 45, where each cylinder contains a piston, such as the pistons 46, 47, 48, 49, 50, FIGS. 8 and 9. At the front end 46, FIG. 5, of the array of cylinders/pistons 40, is five openings/seals 51, 52, 53, 54, 55 for high-pressure airflow from the pistons. (Hereinafter this disclosure may use the flow of high-pressure air to indicate an upstream and downstream location.)

Figure 6:
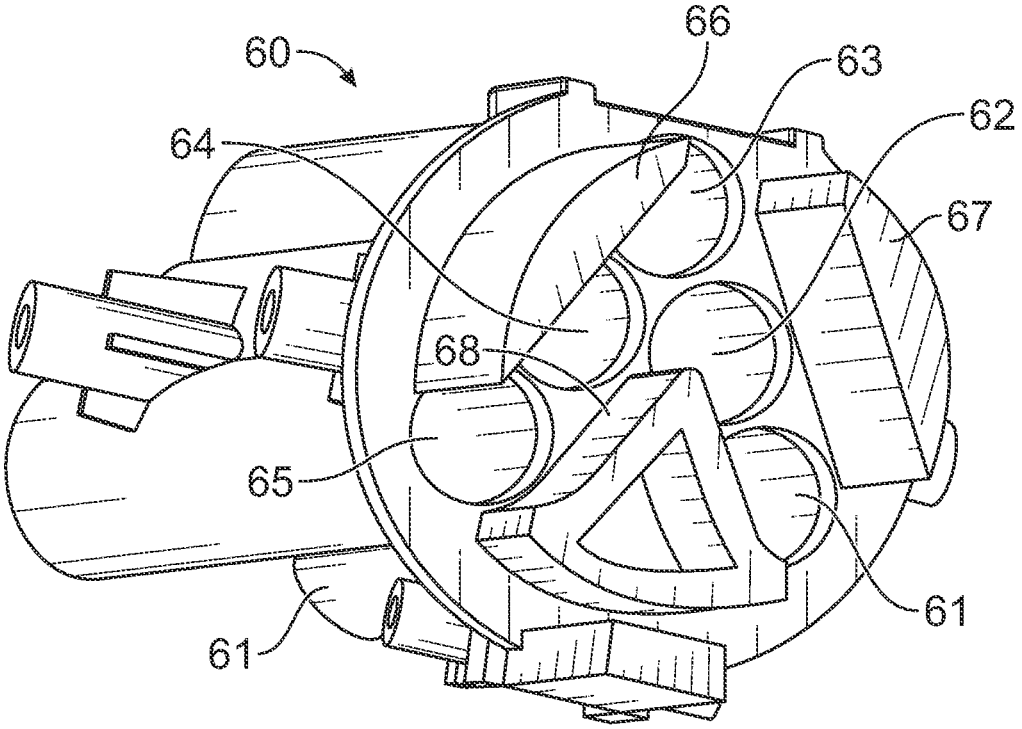
FIG. 6 is an isometric view of the upstream side of an array of barrels of the blaster shown in FIGS. 1-5. (The stream being of high-pressure air created in the array of cylinders.)
Figure 7:
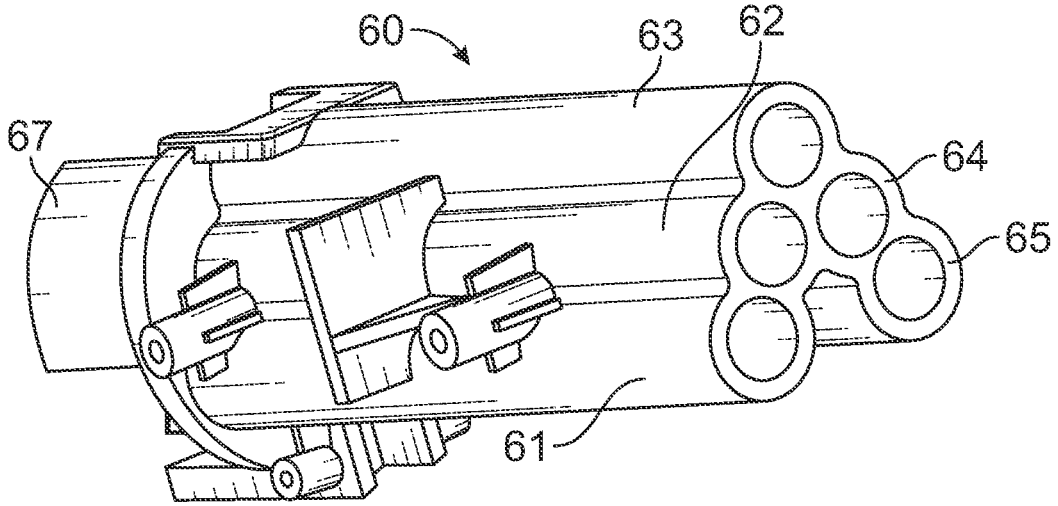
FIG. 7 is an isometric view of the downstream side of the array of barrels shown in FIG. 6.

Forward of the launch spring 30 and the array of cylinders 40 is a cluster or array of multiple barrels 60, FIG. 3, either operated manually or motorized in the alternative. The array may include five barrels 61, 62, 63, 64, 65, see FIGS. 3, 6 and 7, to correspond, but not align, with the five cylinders and pistons. The array of barrels 60 allows the toy blaster 10 to launch multiple beads simultaneously, so as to generally mimic a real shotgun, such as a buckshot shotgun, as a scattershot launcher. By varying the design of some components, more or less than five beads may be launched at any one time; the load of the launch spring, the dimensions and number of cylinders and pistons, the number of barrels and other parameters may have to be adjusted to offer the appropriate play value. The array of barrels 60 also includes two wings 66, 67 and a shelf 68 that form a chamber and help align the beads with the array of barrels. The launching apparatus is thus capable of launching multiple projectiles employing the energy source and pressure distributor couples forward with an alignment system receiving a collection of the projectile rounds, for aligning individual projectile rounds between pressure distributor and the at least one barrel, with the pressure distributor coupling each of the one or more cylinders with a respective one of the individual projectile rounds. An actuator is linked with the energy source for causing the single launch spring of the energy source to move the one or more pistons and launch the projectile rounds. Alternately orientated barrels 60 may be configured in other possible staggered, tower, or pyramid-like shapes, as linear, angular, or rounded.

In the present embodiment, the blaster 10 is designed to discharge five beads, and the force needed to launch all five beads at the same time without extending the length of the cylinders results in the diameters of the pistons 46, 47, 48, 49, 50 being formed somewhat oversized. When the piston diameters are larger than the diameters of the barrels 61, 62, 63, 64, 65, the positions of the pistons are offset and do not align with the positions of the barrels. Such a misalignment prevents the aligned air flow from the pistons/air cylinders to the projectiles being launched and traveling through respective barrels and proper operation of the toy blaster, as it would interfere with the high-pressure airflow for discharge. (See for example in FIG. 3, the misalignment of the array of larger diameter cylinders/pistons 40 in comparison with the array of smaller diameter barrels 60.) In order to overcome this problem, a pressure distributor 70, FIGS. 3, 4, 5, 10 and 11, is mounted to the housing 12, just forward or downstream of the array of cylinders/pistons to receive a determined number of beads to discharge at the same time and to redirect the high-pressure airflow. A bead alignment system 72 is also mounted to the housing 12 rearward or upstream of the array of barrels 60 for aligning those beads with the array of barrels during the priming of the blaster.

Figure 8:
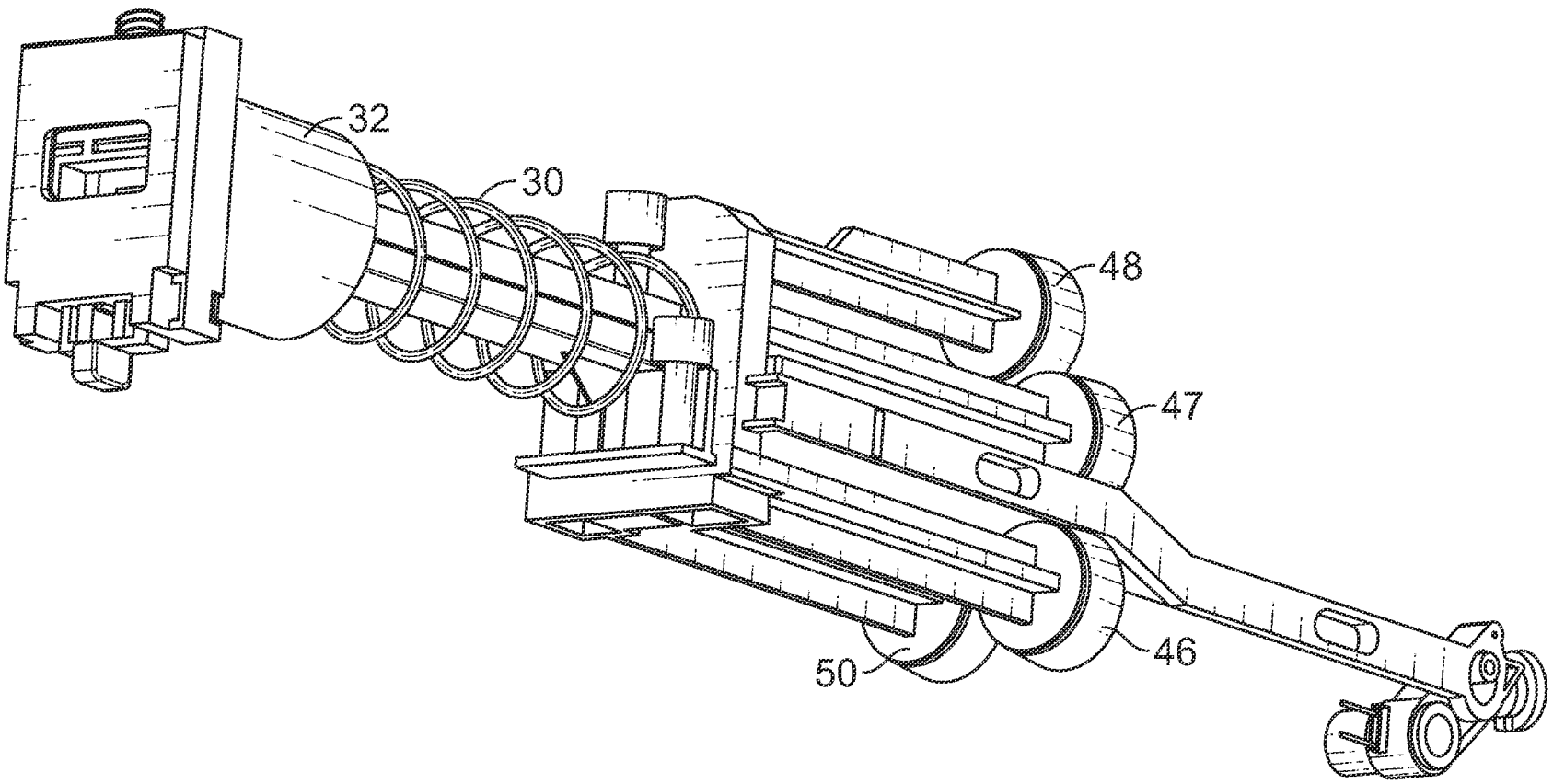
FIG. 8 is a rear looking isometric view of the launch spring, the pistons and a linkage of the toy blaster shown in FIGS. 1-7.
Figure 9:
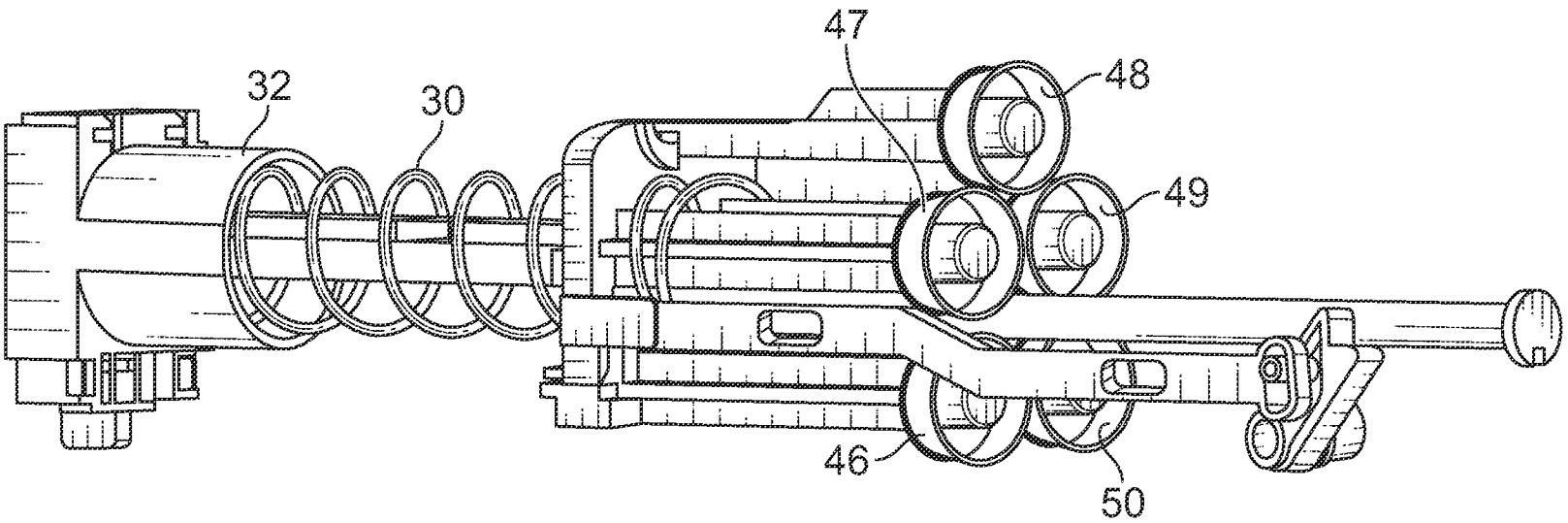
FIG. 9 is a front looking isometric view of the launch spring and the pistons shown in FIG. 8.
Figure 10:
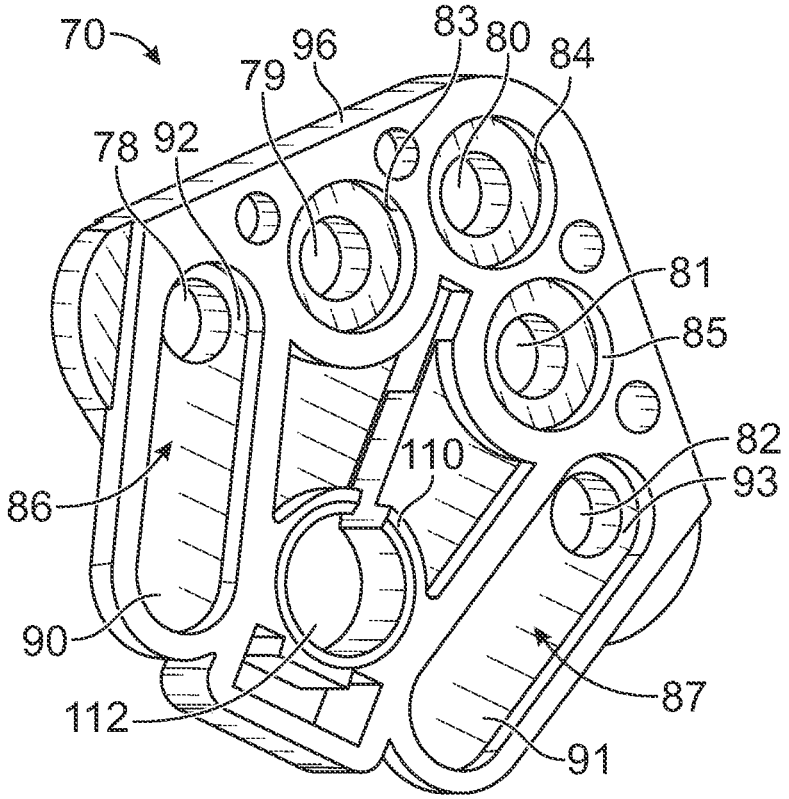
FIG. 10 is an enlarged isometric view of the upstream side of the pressure distributor of the toy blaster shown in FIGS. 1 and 2.
Figure 11:
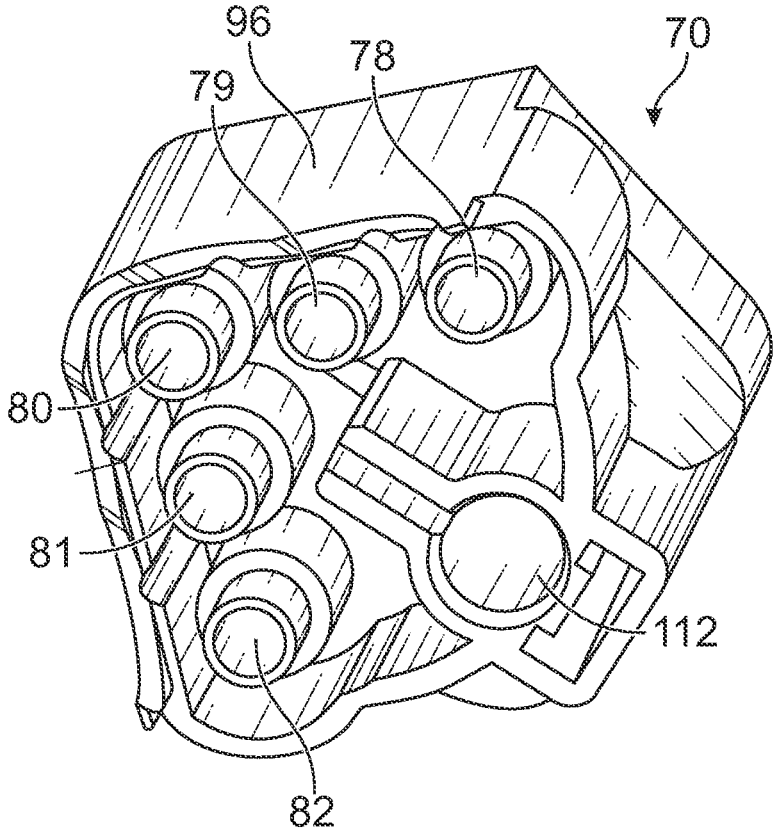
FIG. 11 is an isometric view of the downstream side of the pressure distributor shown in FIG. 10.

Referring now to FIGS. 10 and 11, the pressure distributor 70 has five openings 78, 79, 80, 81, 82 for high-pressure air at the rear or the upstream side where three openings 79, 80, 81 are at the centers of three corresponding recesses 83, 84, 85, and two opening 78, 82 are within slots 86, 87, respectively. The recesses 83, 84, 85 are circular and of a sufficient diameter to receive the three openings/seals 52, 53, 54, FIG. 5. In other words, seals 52, 53, 54 project into respective recesses 83, 84, 85 to ensure high pressure air is passes directly from pistons to barrel. As can be seen in the drawings, there is sufficient room to accommodate and align the three corresponding upper barrels 62, 63, 64, FIGS. 6 and 7, such that the high-pressure air created by the pistons 47, 48, 49, FIGS. 8 and 9, is able to flow without difficulty to the corresponding barrels. The lower openings/seals 51, 55, FIG. 5, of the cylinders 41, 45, however, do not align with the lower barrels 61, 65, FIG. 6. To accommodate the lower cylinders 41, 45, the two slots 86, 87 of the pressure distributor 70 have a width to accommodate the diameters and slot borders of the openings/seals 51, 55 where lower portions 90, 91 of the pressure distributor slots align with the two lower openings/seals 51, 55. At opposite upper end portions 92, 93 of the pressure distributor slots where the openings 78, 82 are located, the openings 78, 82 are aligned with the lower barrels 61, 65. The engagement of the seals 51, 55 in slots 86, 87 creates and enclosed space to direct flow of high pressure air from the pistons to the openings 78, 82 aligned with projectiles and barrels. Thus, high-pressure air from the cylinders 41, 45 enters the pressure distributor at the lower portions 90, 91, travels upward along the pressure distributor slots 86, 87 and exits through the openings 78, 82, to re-direct high-pressure air in slots to compensate for the offset of the cylinders 41, 45 relative to the openings 78, 82.

The pressure distributor 70 also includes a top surface 96 that facilitates the positioning of beads when the beads drop from the hopper 24. At the front or downstream side of the pressure distributor are tubes around the openings 78, 79, 80, 81, 82 for receiving tubular seals 94, 95, 96, 97, 98, FIG. 14. At the lower portion 110 of the pressure distributor 70 is another opening 112 that allows the pressure distributor to be mounted on and slide along a rod 114, FIGS. 4 and 5.

Figure 12:
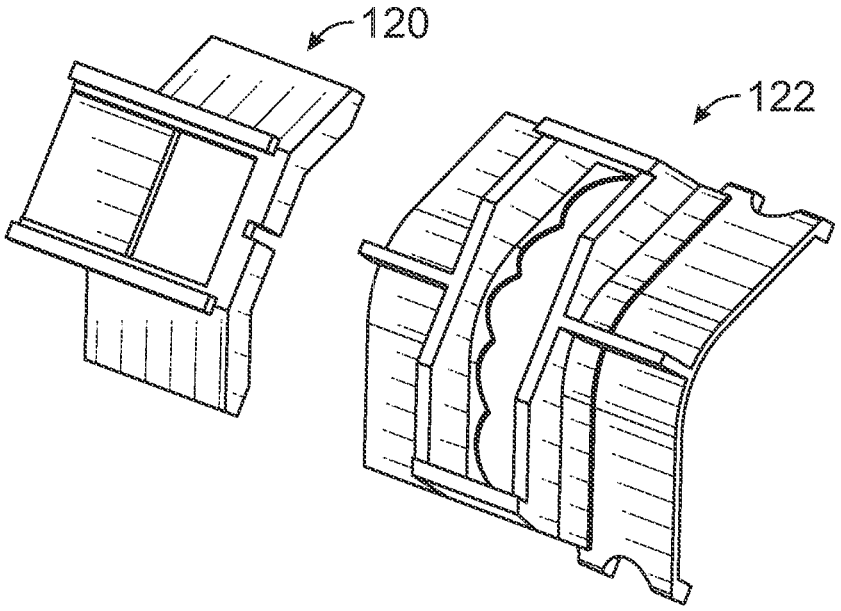
FIG. 12 is an enlarged, downward looking isometric view of a portion of the bead alignment system of the toy blaster shown in FIGS. 1 and 2.
Figure 13:
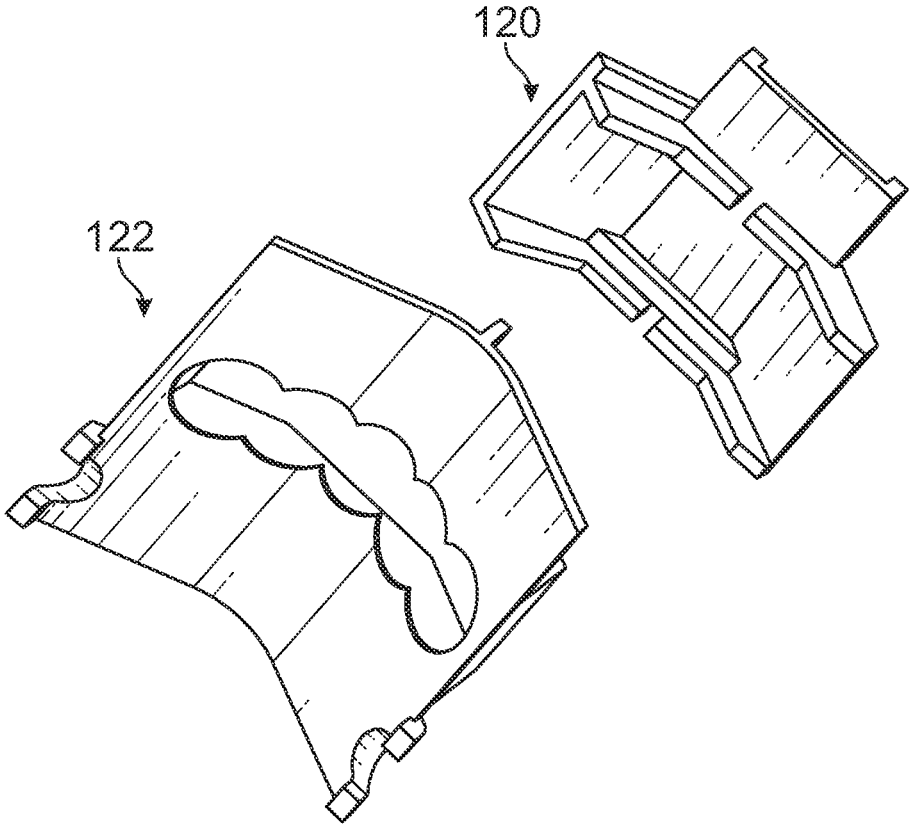
FIG. 13 is an upward looking isometric view of the bead alignment system shown in FIG. 12.
Figure 14:
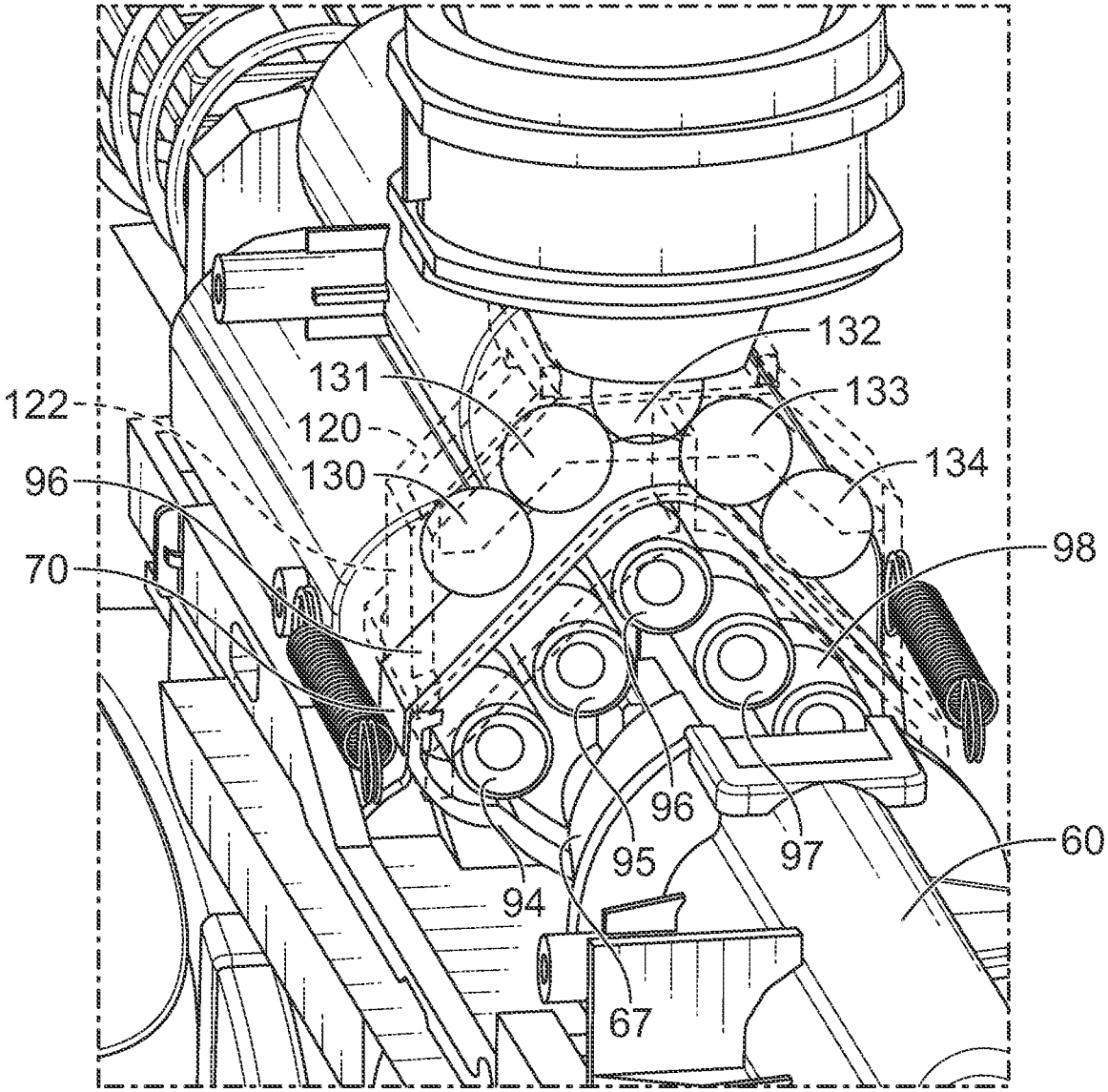
FIG. 14 is an isometric view partially in dotted lines of the bead alignment system with beads dropped from a hopper of the toy blaster shown in FIGS. 1 and 2.
Figure 15:
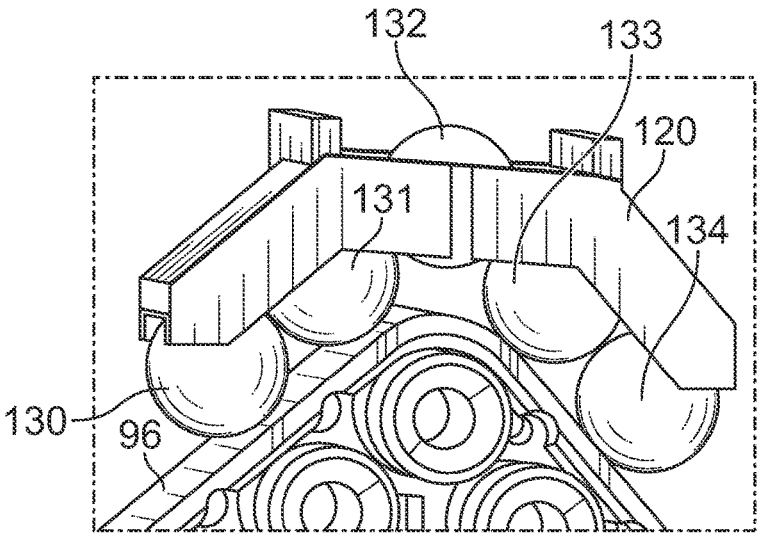
FIG. 15 is another isometric view of the beads and a portion of the bead alignment system shown in FIG. 14.
Figure 16:
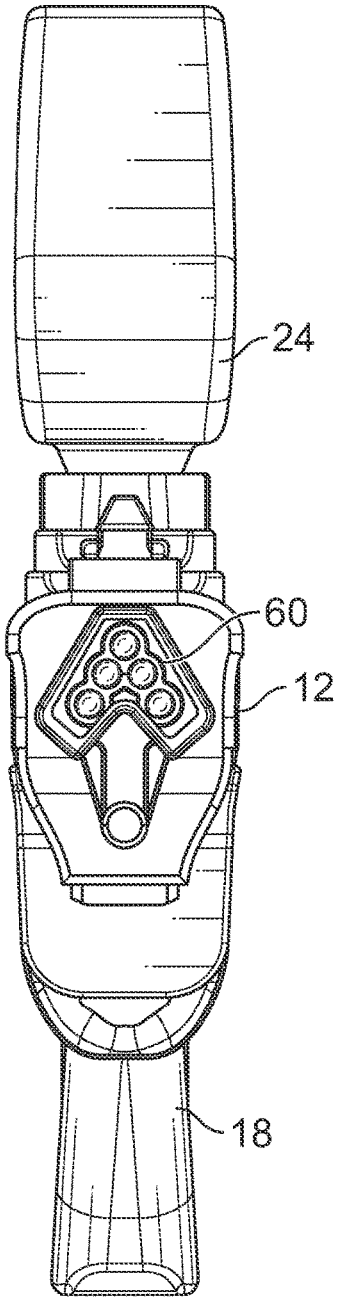
FIG. 16 is a front elevation view of the toy blaster shown in FIGS. 1 and 2.

The bead alignment system includes an upper staging component 120, FIGS. 12 and 13, a lower staging component 122 and the top surface 96, FIGS. 10, 11, 14 and 15, of the pressure distributor 70. Super absorbent polymer beads 130, 131, 132, 133, 134, FIGS. 14 and 15, from the hopper 24 fall by gravity into the bead alignment system. The beads move in a two-step process. In the first step, the beads fall through the upper staging component 120 and are collected by the lower staging component 122 to space apart and determine the number of beads allowed to move from the hopper as shown in FIGS. 14 and 15. The five beads land and rest on the top surface 96 of the pressure distributor 70. The second step occurs when an operator manipulates the energizing priming handle 16 when the operator primes the blaster. The array of barrels forms a launch chamber with the wings 66, 67 and the shelf 68, FIG. 6.

The beads come to rest on the shelf 68 and between the wings 66, 67 so as to align the beads with the array of barrels and place the beads in position to be discharged once the trigger is activated.

In the embodiment shown in the drawings here, FIGS. 1-16, the upper and lower staging components 120, 122 and the shelf 68 are designed to handle five beads as mentioned above, however, other components may be designed to handle more or fewer beads at the same time.

Figure 17:
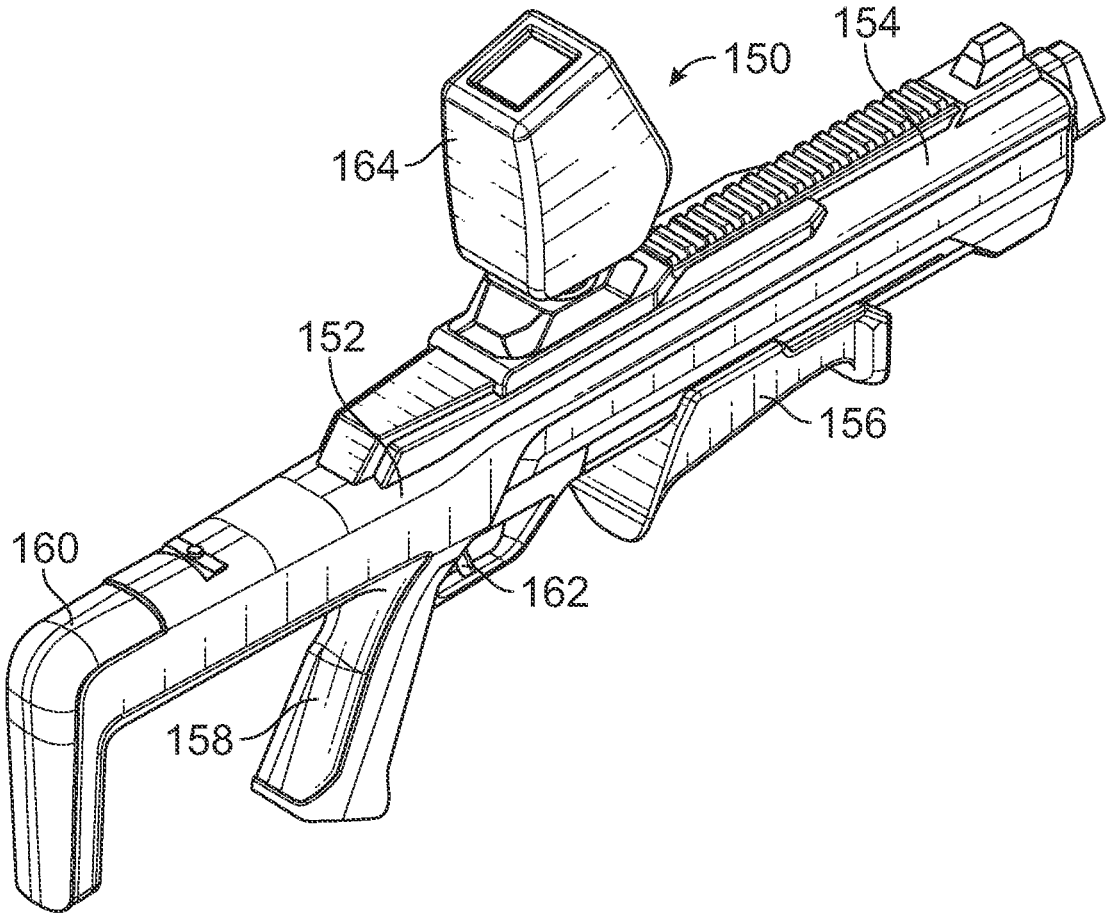
FIG. 17 is an isometric view of another preferred embodiment of the present invention in the form of a toy blaster for simultaneously discharging multiple hydrated super absorbent polymer beads.

Another embodiment of a toy launching apparatus for simultaneously discharging multiple hydrated super absorbent polymer beads is shown in FIGS. 17-32. The apparatus may again take the form of a stylized toy blaster 150 FIGS. 17 and 18, having an outer shell or housing 152, a barrel portion 154, a forearm or priming handle 156, a grip portion 158, a shoulder stock portion 160, a trigger assembly 162, a removable magazine or hopper 164 for storing hydrated super absorbent polymer beads and an energy source 166 located within and mounted to the housing. While the toy launching apparatus may have the appearance of the stylized toy blaster as shown in the drawings, the apparatus may also resemble a suitable toy launcher exemplified by existing NERF® brand 'blasters.'

Figure 18:
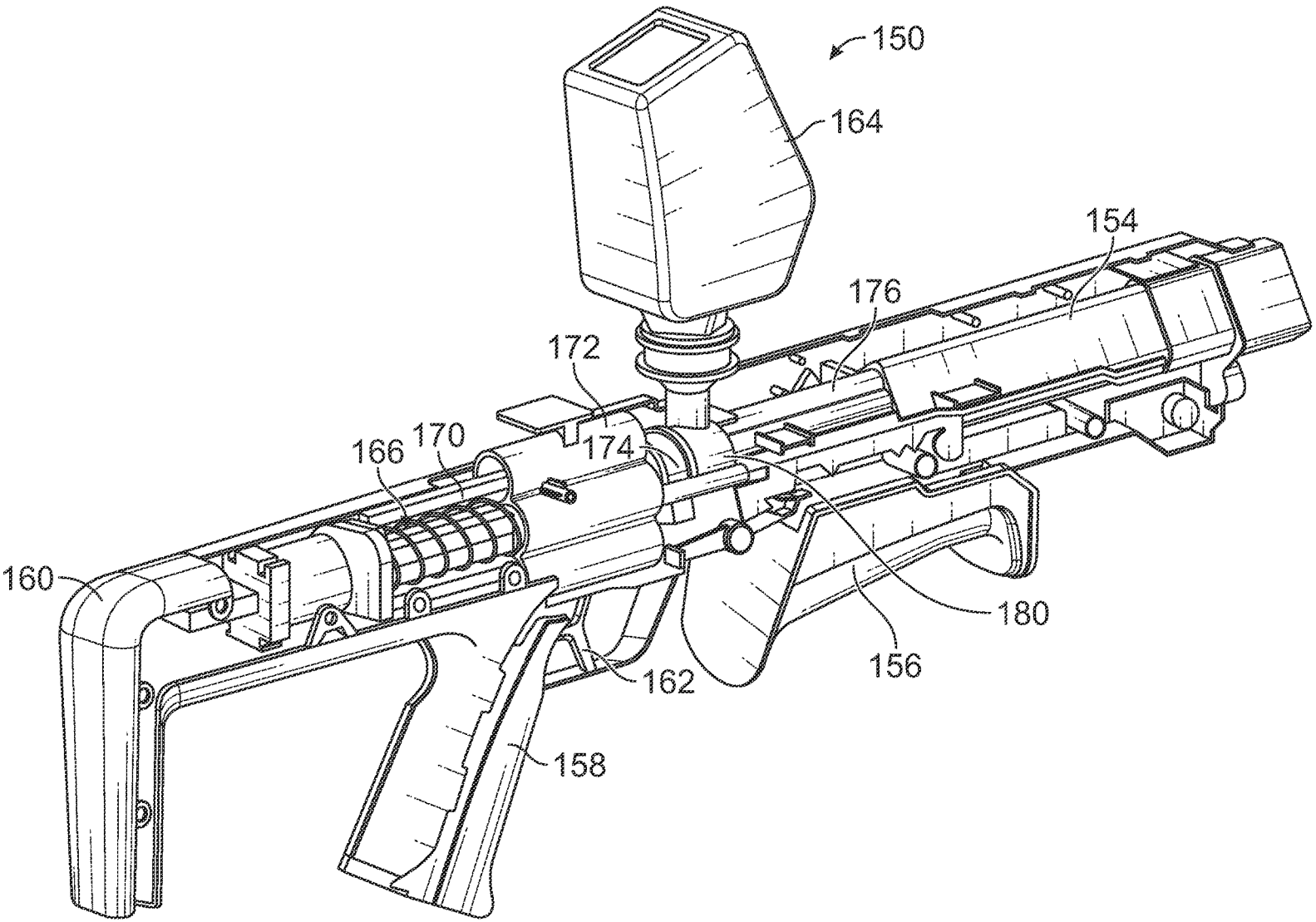
FIG. 18 is an isometric view of the toy blaster shown in FIG. 17, with part of the housing removed.

Part of the housing has been removed from the blaster 150, FIG. 18, to illustrate internal components mounted to the toy blaster, including a compressible launch spring 170 arranged like the earlier embodiment blaster 10. Forward of the launch spring 170 is an array of cylinders/pistons 172, a pressure distributor 174 and an array of barrels 176. A bead alignment system 180, FIGS. 18 and 19, is mounted to the housing 152 and located beneath the hopper 164 to receive the hydrated super absorbent polymer beads from a funnel 182, however, the bead alignment system 180 is different from the bead alignment system of the blaster 10 mentioned above.

Figure 20:
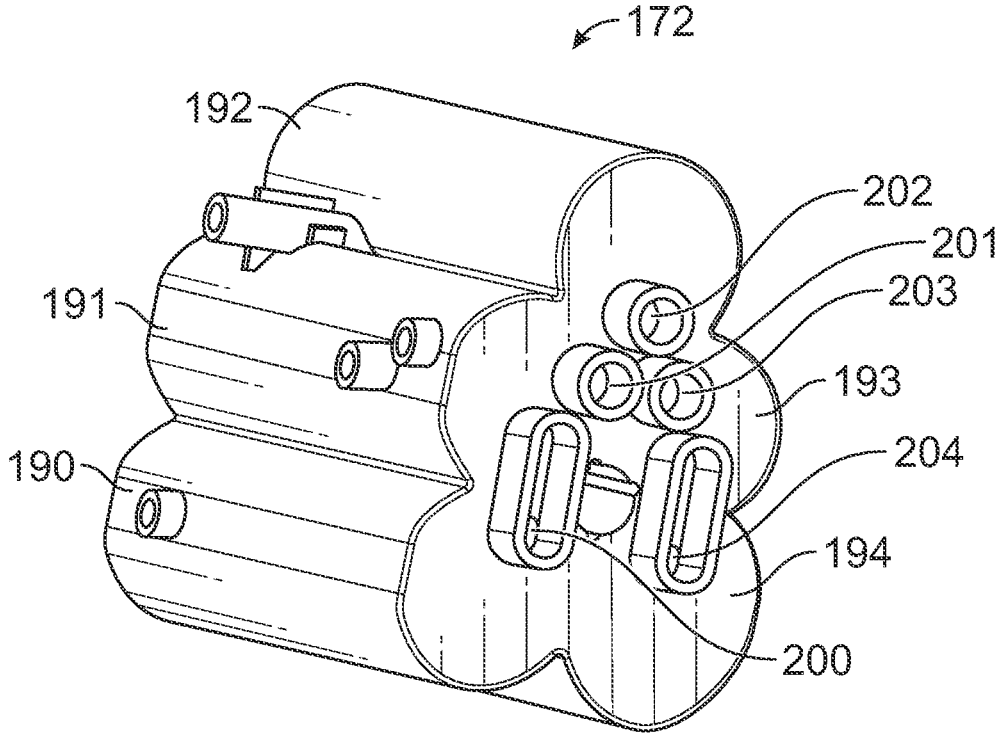
FIG. 20 is an isometric view of the downstream side of the array of cylinders of the toy blaster shown in FIG. 17.
Figure 21:
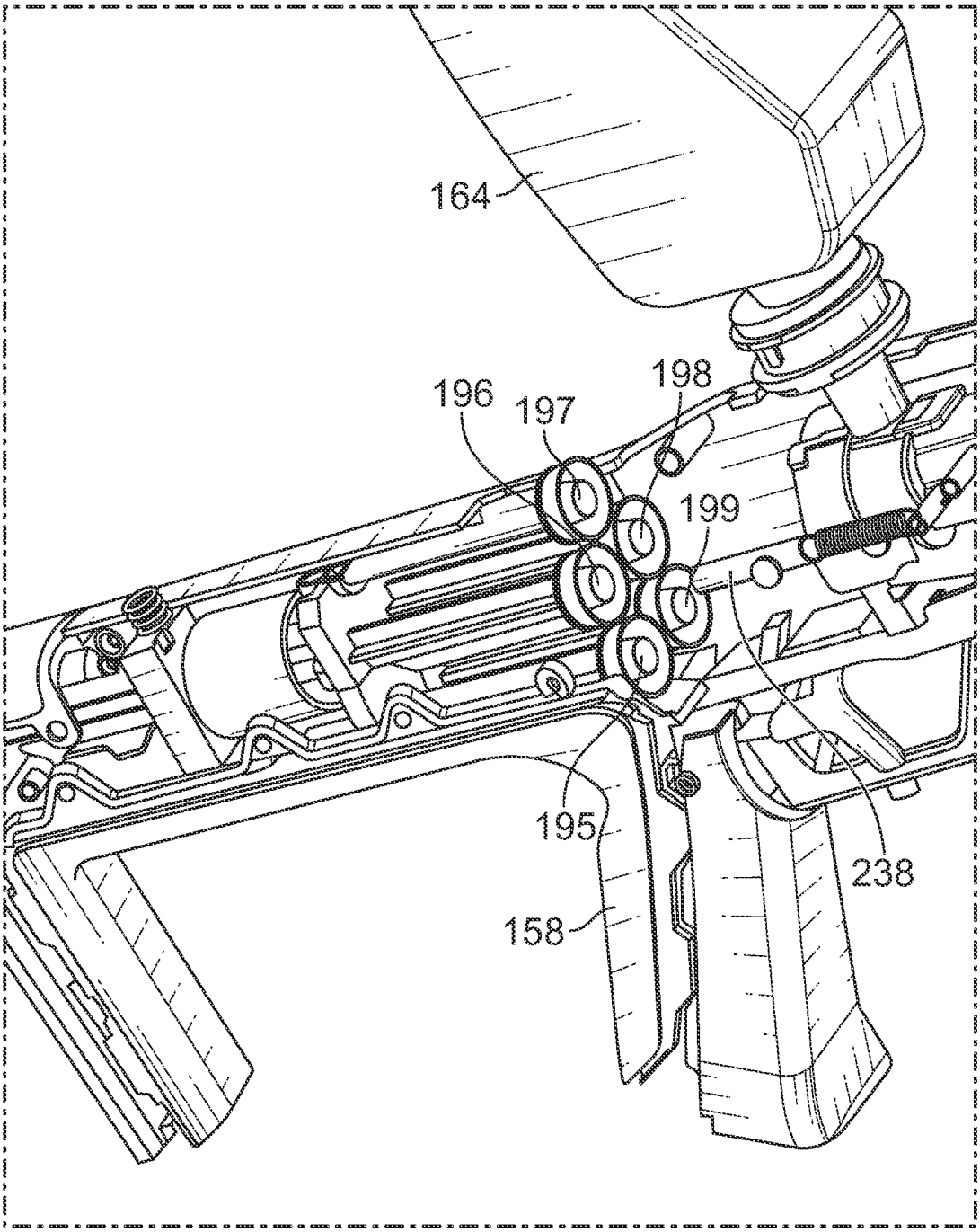
FIG. 21 is an isometric view of the pistons in the array of cylinders of the toy blaster shown in FIG. 17.
Figure 22:
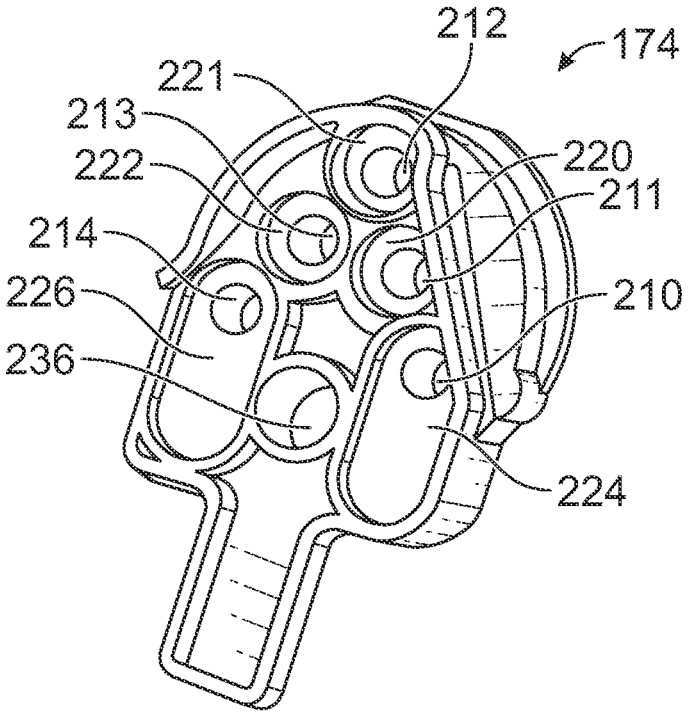
FIG. 22 is an isometric view of the upstream side of the pressure distributor of the toy blaster shown in FIG. 17.
Figure 23:
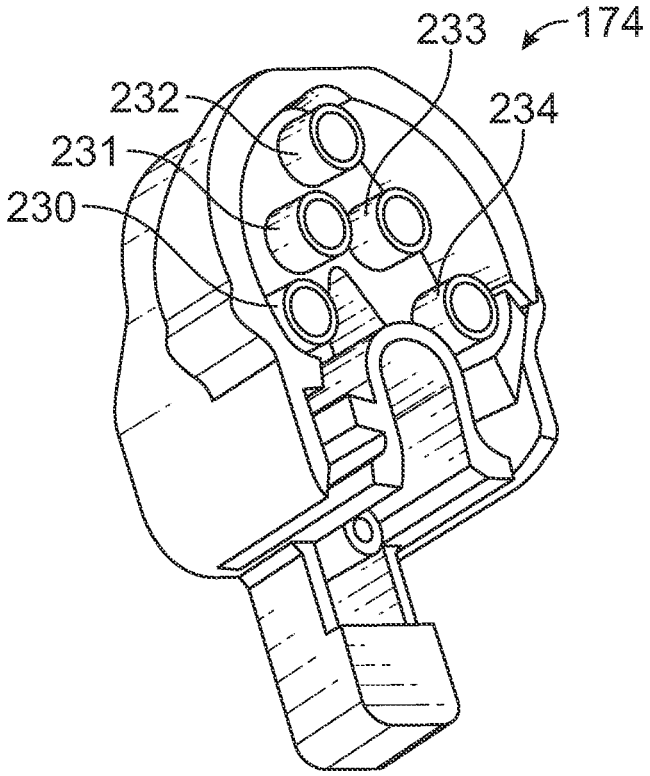
FIG. 23 is an isometric view of the downstream side of the pressure distributor shown in FIG. 22.

The array of cylinders/pistons 172, FIGS. 20 and 21 is similar to the array of cylinders/pistons 40, FIGS. 3 and 4. The array 172 includes five cylinders 190, 191, 192, 193, 194, FIG. 20, and five pistons 195, 196, 197, 198, 199, FIG. 21. Because the cylinders and pistons are oversized, the downstream cylinder and seal openings 200, 201, 202, 203, 204, FIG. 20, are formed of the three upper cylinder/seal openings 201, 202, 203 and the two lower slots for the openings 200, 204. The pressure distributor 174, FIGS. 22 and 23, includes five air openings 210, 211, 212, 213, 214 where the upper three openings 211, 212, 213 are surrounded by recesses 220, 221, 222 while the lower openings 210, 214 are surrounded by slots 224, 226 to match the cylinder/seal openings 200, 201, 202, 203, 204. At the front portion or downstream side of the pressure distributor 174, FIG. 23, are five small seal cylinders 230, 231, 232, 233, 234, which are extensions of the five air openings 210, 211, 212, 213, 214. Another lower opening 236 is formed in the pressure distributor 174 to receive a slide rod 238, FIG. 21.

Figure 24:
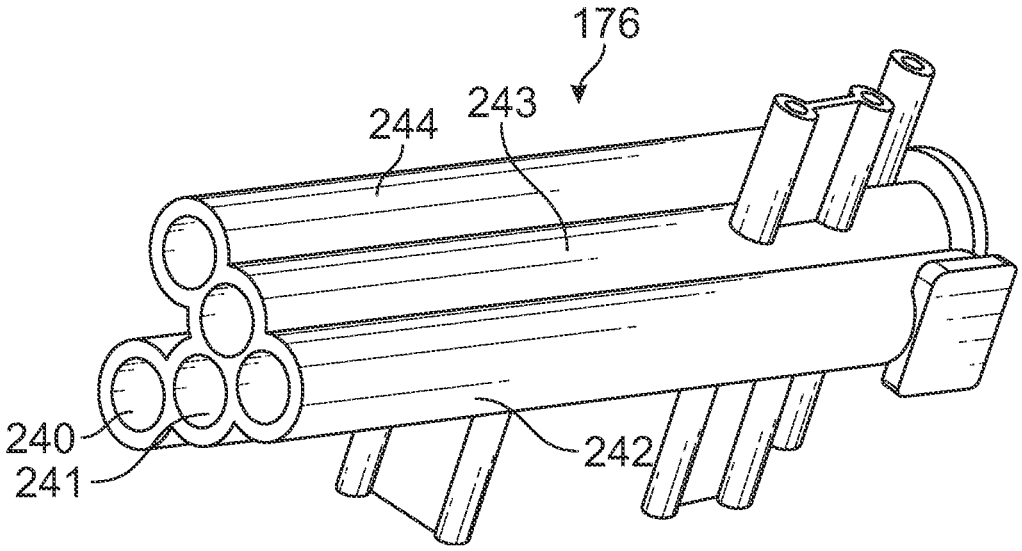
FIG. 24 is an isometric view of the downstream side of the array of barrels of the toy blaster shown in FIG. 17.
Figure 25:
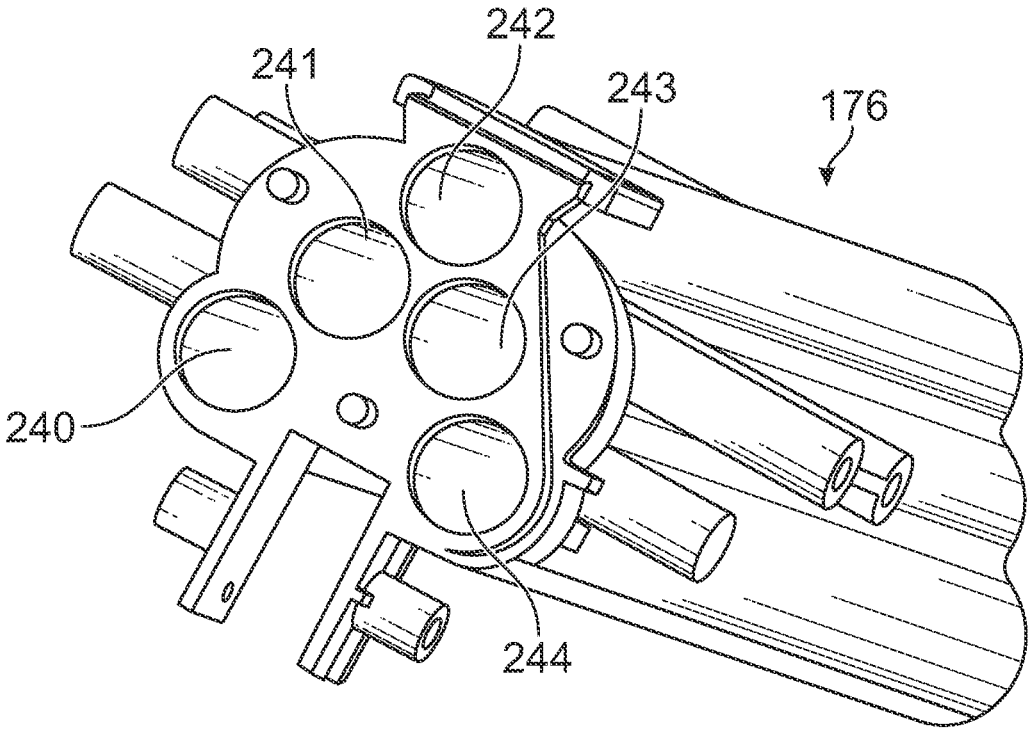
FIG. 25 is an isometric view of the upstream side of the array of barrels shown in FIG. 24.
Figure 32:
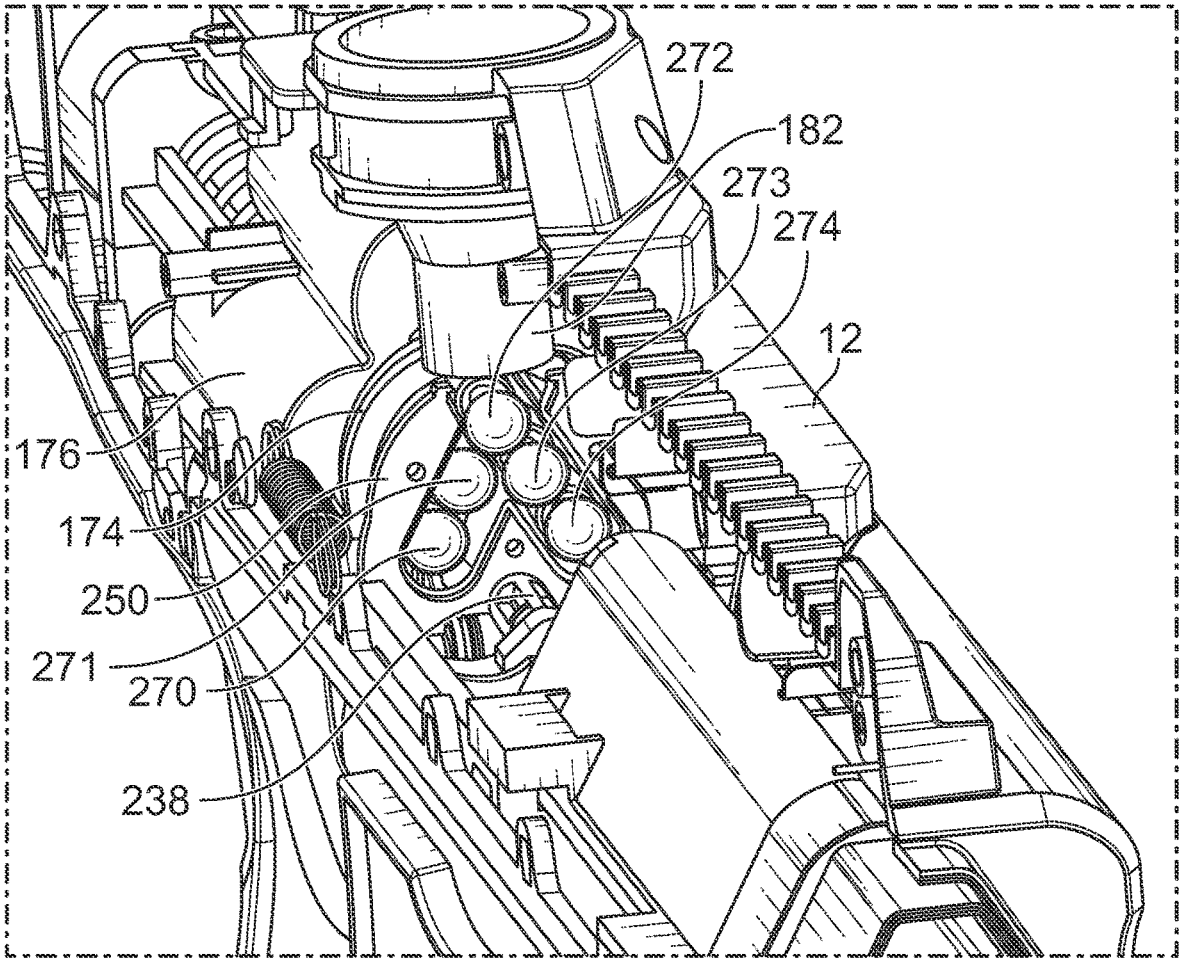
FIG. 32 is an isometric view of the beads in the V-shaped bead support of the toy blaster shown in FIG. 17 and barrel of FIGS. 24-25, with FIGS. 32A, 32B, 32C as exemplary alternate barrels configurations.
Figure 32A:
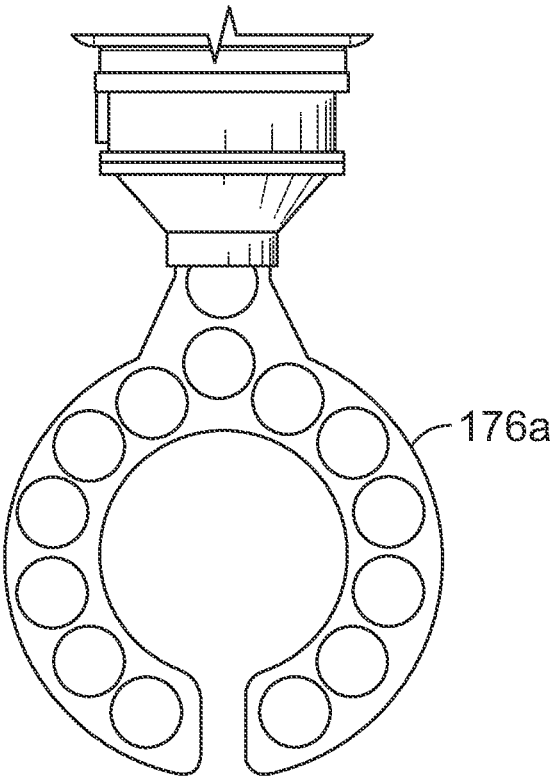
Figure 32B:
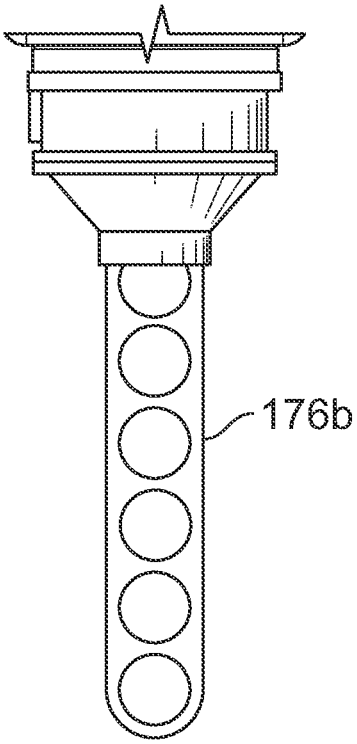
Figure 32C:
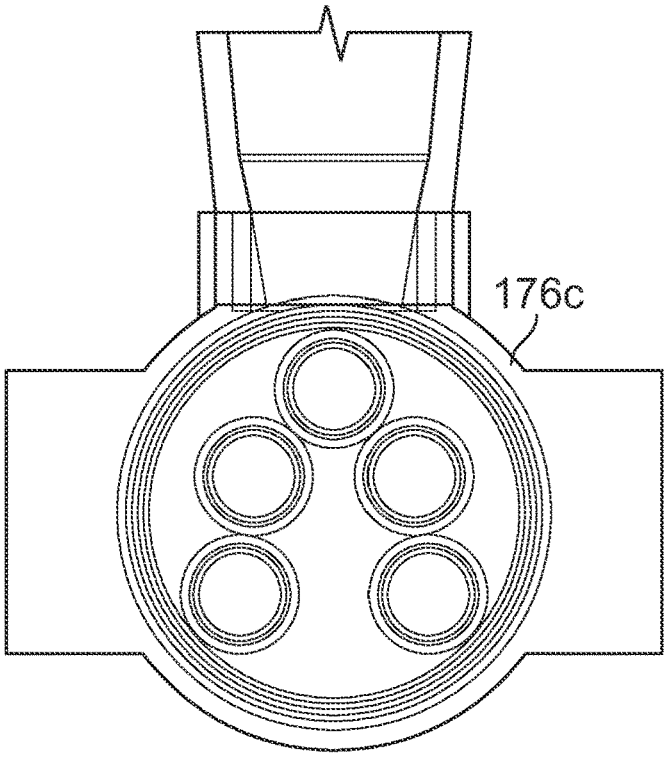

Referring now to FIGS. 24 and 25, the array of barrels 176 includes five barrels 240, 241, 242, 243, 244 in a V-shaped configuration, approximately 60 degrees with considerable variation, and other configurations where rounds capacities may vary. Alternate barrels of FIGS. 32A-32C illustrate exemplary circular, linear, and U-shaped barrels 176*a*, 176*b*, 176*c*.

Figure 19:
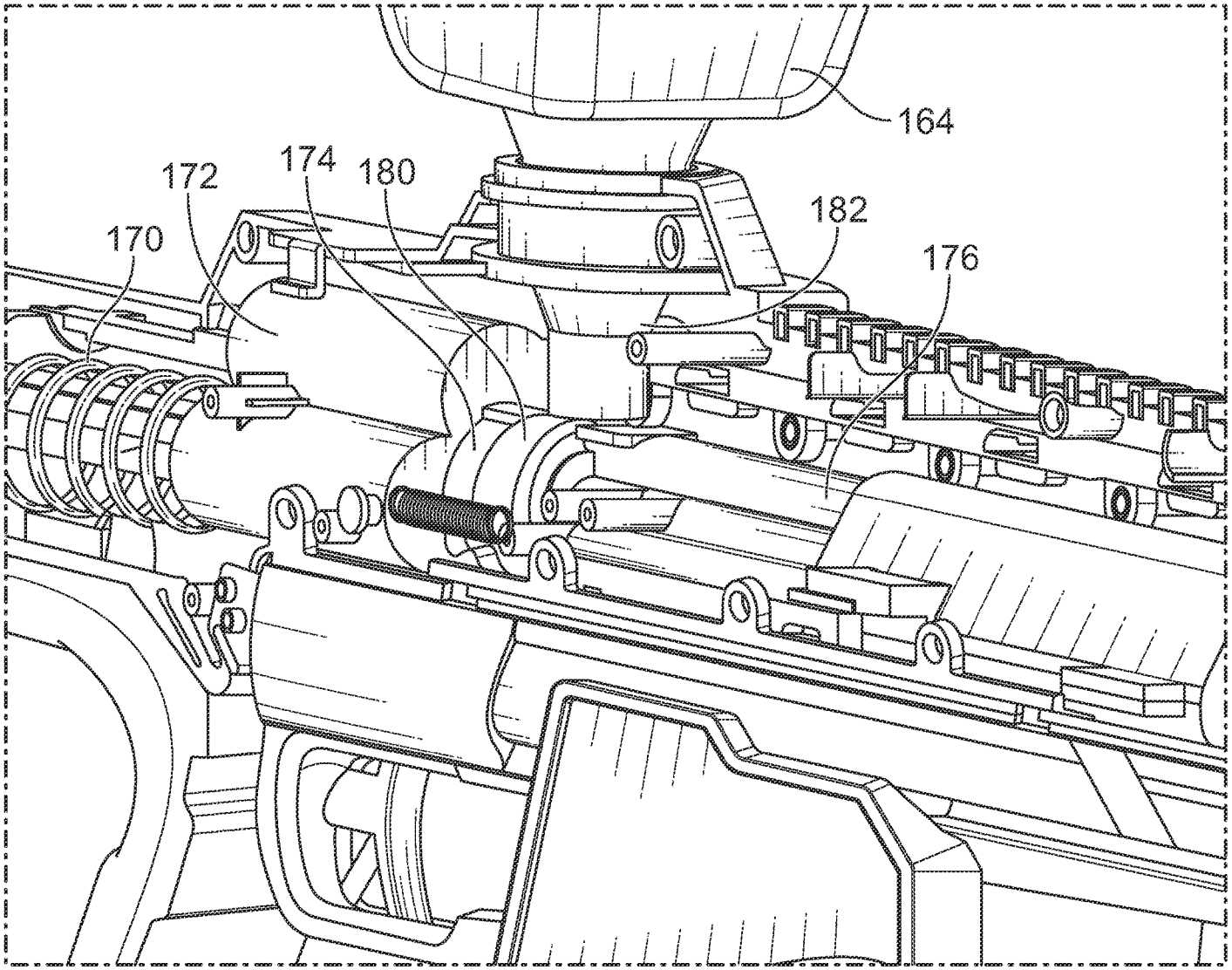
FIG. 19 is an enlarged isometric view of an array of cylinders with pistons, a pressure distributor and an array of barrels of the toy blaster shown in FIG. 17.
Figure 26:
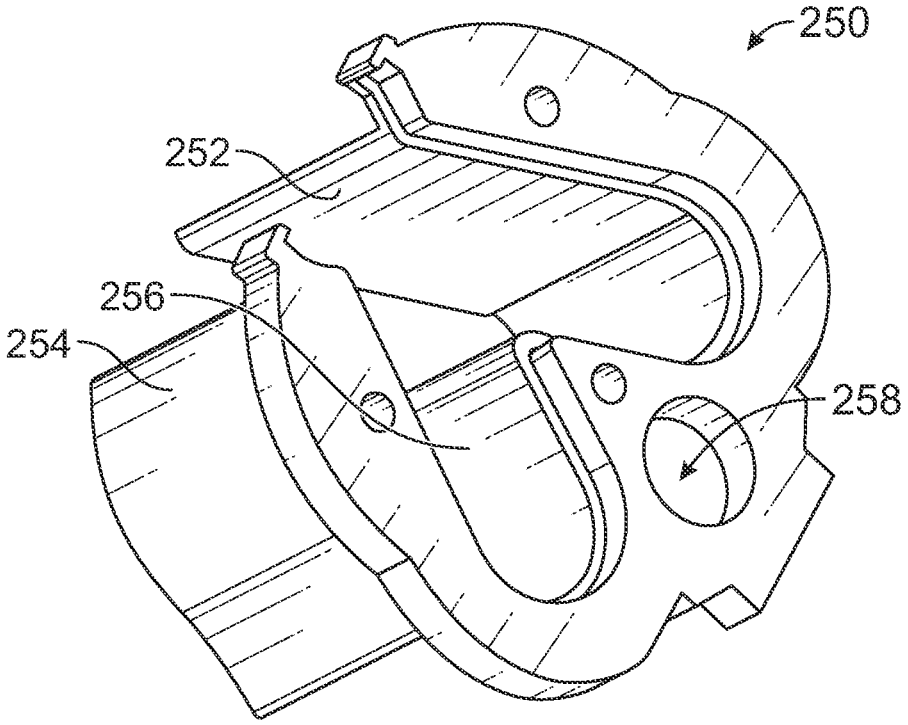
FIG. 26 is an isometric view of the downstream side of a V-shaped bead support of the toy blaster shown in FIG. 17.
Figure 27:
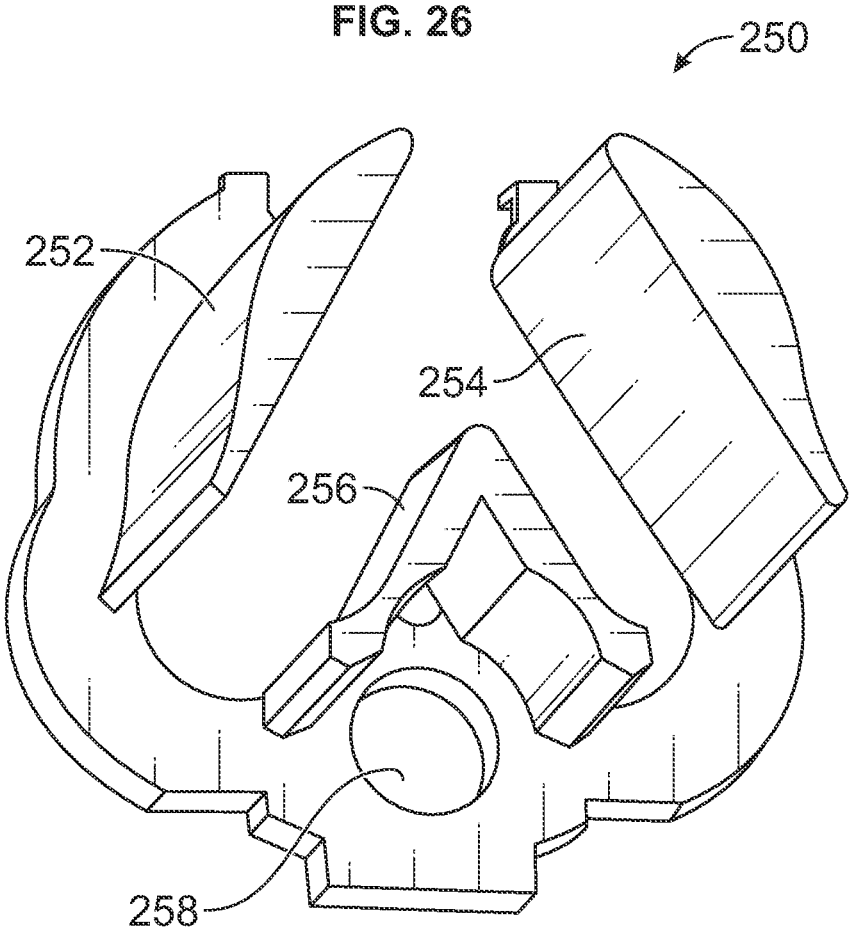
FIG. 27 is an isometric view of the upstream side of the V-shaped bead support shown in FIG. 26.
Figure 28:
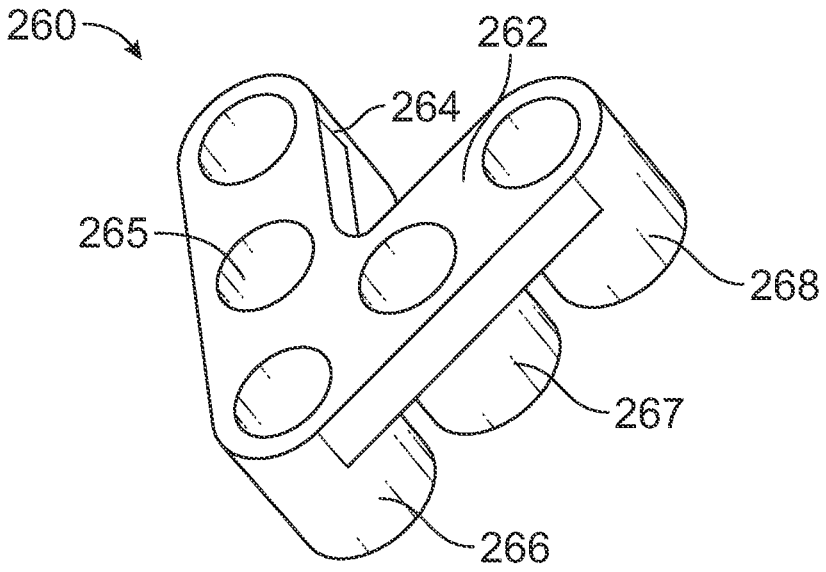
FIG. 28 is an isometric view of the upstream side of a seal component of the toy blaster shown in FIG. 17.
Figure 29:
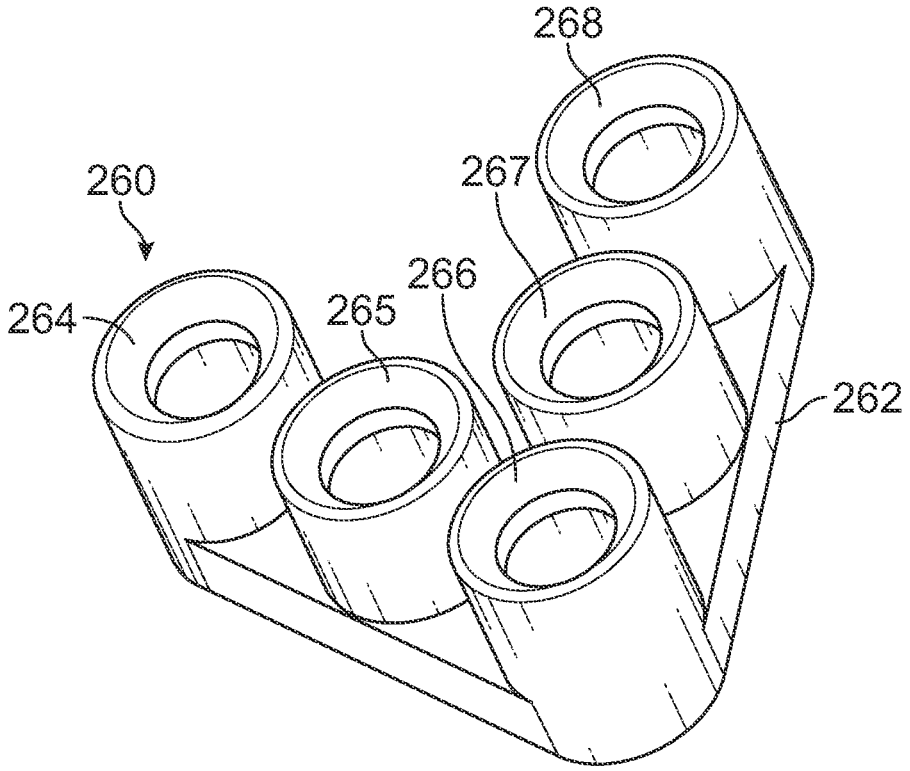
FIG. 29 is an isometric view of the downstream side of the seal component shown in FIG. 28.
Figure 30:
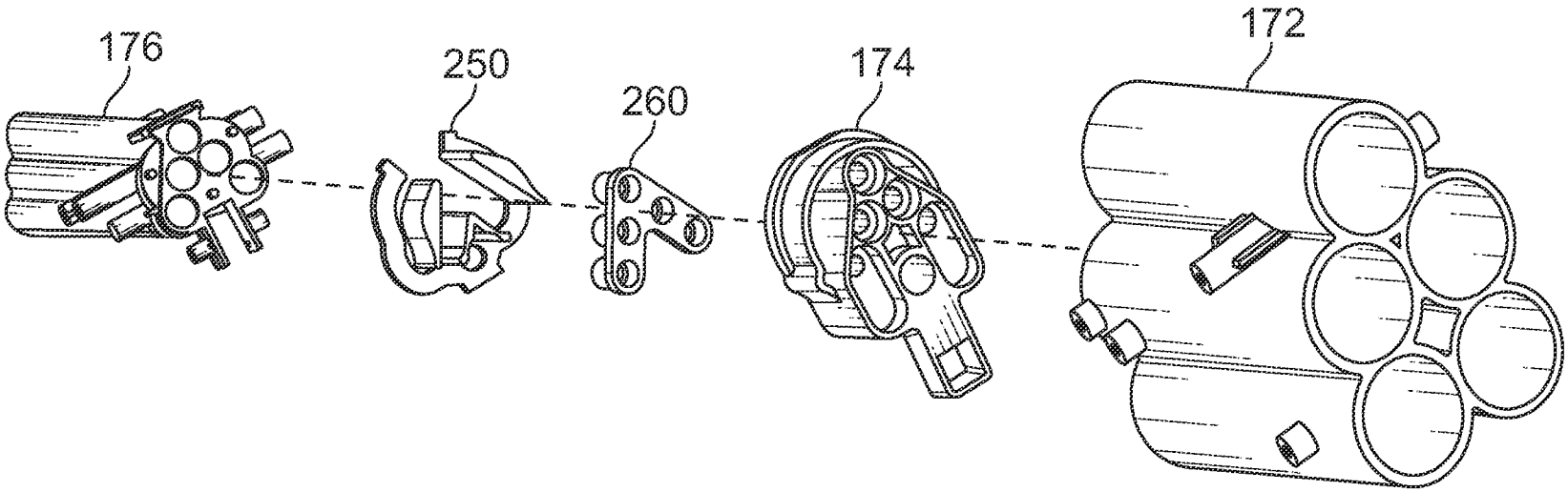
FIG. 30 is an isometric downstream view of the array of cylinders, the pressure distributor, the seal component, the V-shaped bead support and the array of barrels of the toy blaster shown in FIG. 17.
Figure 31:
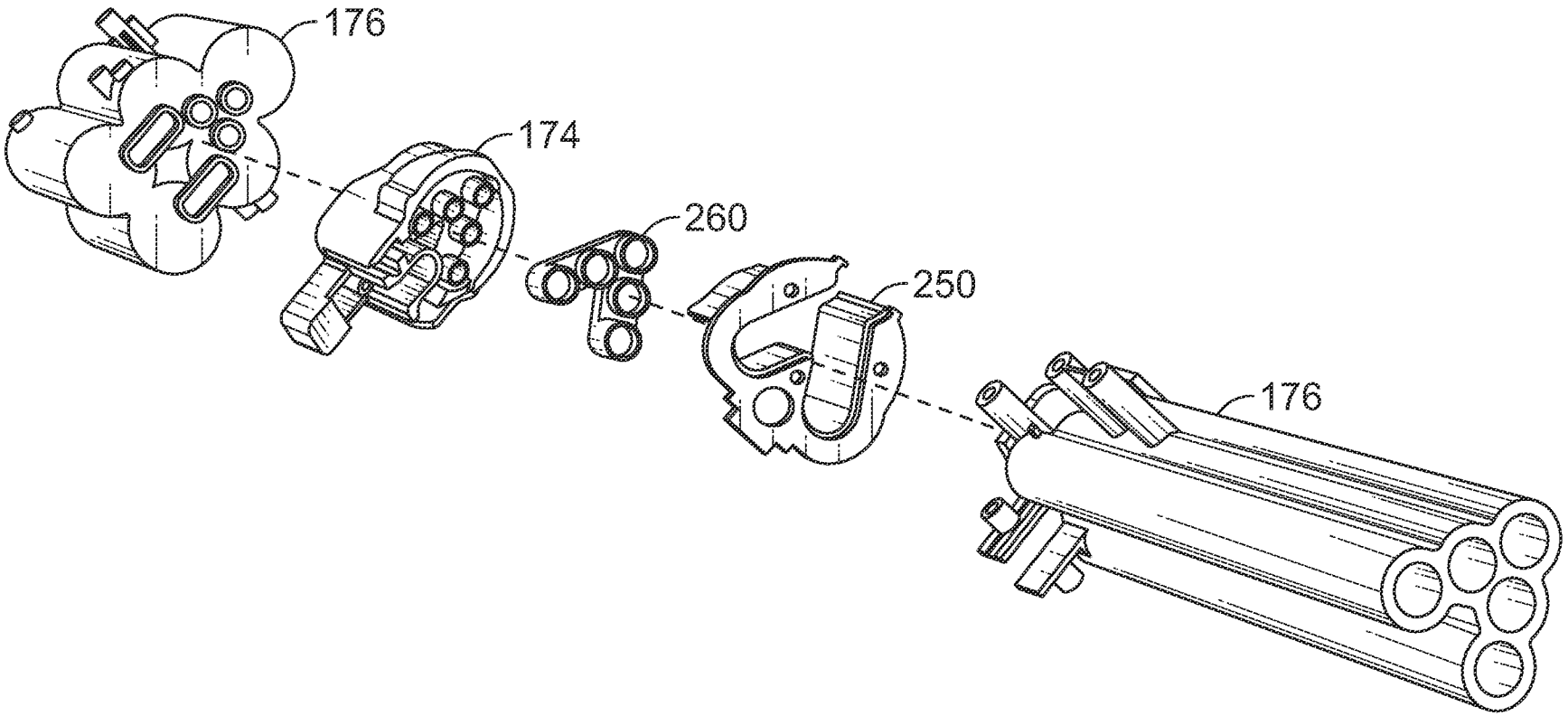
FIG. 31 is an isometric upstream view of the array of cylinders, the pressure distributor, the seal component, the V-shaped bead support and the array of barrels shown in FIG. 30.

The bead alignment system 180, FIGS. 19, 26 and 27, includes a V-shaped bead support 250 with space for five hydrated super absorbent polymer beads. The V-shape support subtends sixty degrees so as to align the beads with the array of multiple barrels that also subtends sixty degrees. The bead support may include two wings 252, 254, a V-shaped shelf 256 to facilitate a chamber, and a bottom opening 258 for the rod 238. The bead alignment system 180 may also include a V-shaped gasket or seal component 260, FIGS. 28 and 29. The seal component 260 includes V-shaped backing 262 and five spaced-apart nozzle tubes 264, 265, 266, 267, 268. The wings 254, 256 and the shelf 256 of the bead support 250 form a chamber around the beads resting on the shelf 256 along with the seal component 260 against the pressure distributor 174. The downstream side of the pressure distributor 174, FIGS. 30 and 31 receives the nozzle tubes. It is noted that the V-shaped component 250, the seal component 260, the array of barrels 176 and the array of cylinders 172 may be designed at other angles more or less than sixty degrees. FIGS. 30 and 31, illustrate the placement sequence of the array of cylinders/pistons 172, the pressure distributor 174, the seal component 260, the support component 250, and the array of barrels 176. The chamber holding the hydrated beads 270, 271, 272, 273, 274 in a V-shaped configuration and they are aligned with the barrels before discharge as shown in FIG. 32 in a V-shaped configuration, approximately 60 degrees, but other orientations e.g. U, I linear, or circular, and rounds capacities may vary. For example, FIGS. 32A, 32B, 32C illustrate alternate barrels in circular, linear, and U-shaped barrels 176*a*, 176*b*, 176*c* respectively. A wide range of barrel orientations may be employed as possible staggered, tower, or pyramid-like shapes, as linear, angular or rounded.

Figure 33:
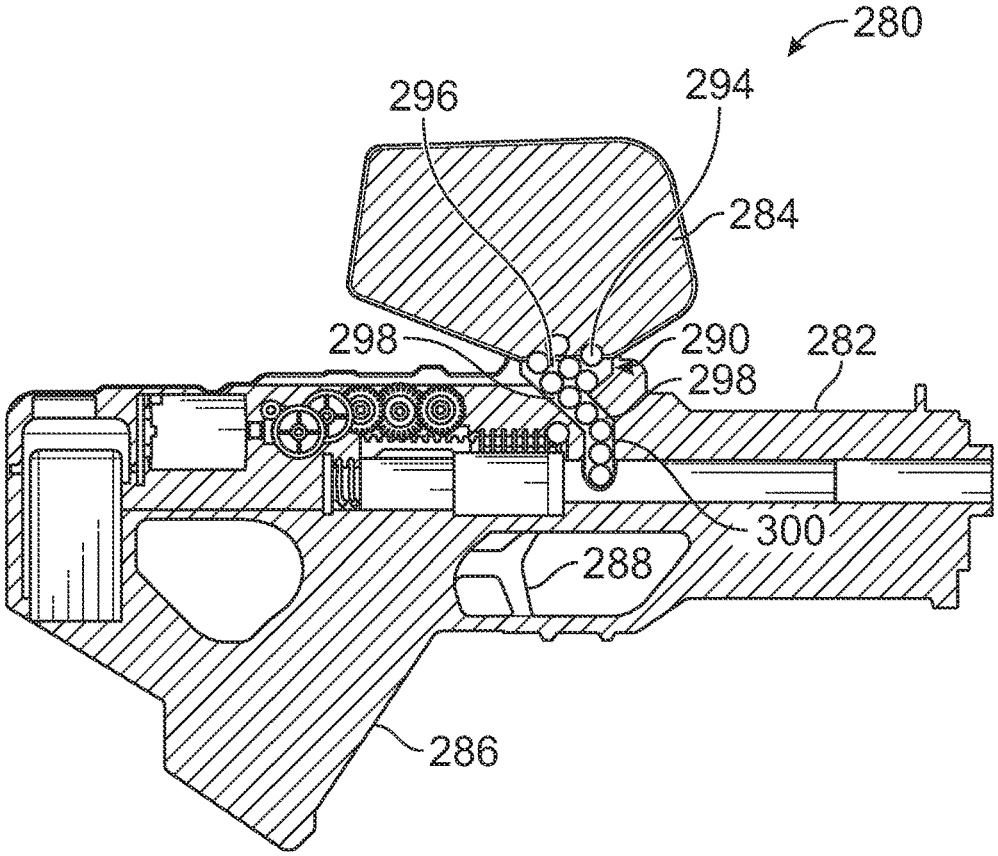
FIG. 33 is a side elevation view of still another preferred embodiment of the present invention in the form of a toy blaster or launcher having an oblique bead alignment system for hydrated super absorbent polymer beads.

In yet another embodiment of a toy launching apparatus 280 FIG. 33, having a barrel portion 282, a hopper 284, a grip 286, a trigger 288, and a bead alignment system 290 includes a non-linear path 292 for hydrated super absorbent polymer beads 294. The non-linear path may include an upper funnel 296 above an angled preload conduit 298, both of which are located above a lower vertical segment 300. The angled preload conduit 298 includes an oblique segment or extension channel which facilitates preload staging. The toy launching apparatus includes at least one barrel mounted to the housing, with a funnel in the housing for interfacing to a hopper for storing multiple projectile rounds. The energy source launches one or more projectile rounds from the hopper, the energy source including a single launch spring for moving one or more pistons within one or more cylinders. A pressure distributor operatively coupling with each of the one or more cylinders forward the one or more pistons, and an alignment system is provided for receiving a collection of the projectile rounds from the hopper, for aligning individual projectile rounds between pressure distributor and the at least one barrel, with the pressure distributor coupling each of the one or more cylinders with a respective one of the individual projectile rounds. The actuator at the housing is linked with the energy source for causing the single launch spring of the energy source to move the one or more pistons and launch the individual projectile rounds through the at least one barrel. The alignment system works with the preload staging conduit for receiving the collection of the projectile rounds from the hopper and may include a preload staging chamber in mechanical communication with the preload staging conduit for aligning individual projectile rounds between pressure distributor and the at least one barrel, with the pressure distributor coupling each of the one or more cylinders with a respective one of the individual projectile rounds. The one or more pistons may include a plurality of pistons, with the one or more cylinders including a plurality of cylinders, one each of the plurality of pistons being within one each of the plurality of cylinders. The alignment system positions the predetermined plural number of projectile rounds from the collection received from the hopper and aligns the predetermined plural number of projectile rounds with the pressure distributor coupling each of the plurality of cylinders with one of the predetermined plural number of projectile rounds. The projectile rounds may be provided as hydrated super absorbent polymer beads.

In operation, the user of the toy blaster 10 causes a large number of super absorbent polymer beads to expand by placing the beads in a container of water or by placing the beads into the container followed by the addition of water. Or, the beads and water may be mixed in the hopper. The size and weight of the beads will have been predetermined to operate with the launch spring and the size and volume of the cylinders and pistons. Once the beads are expanded and the hopper 24 is mounted to the toy blaster 10, the predetermined number of beads, five chosen for the toy blaster 10 and the blaster 150, drop by gravity from the hopper into a staging area formed by the upper and lower staging components 120, 122 and the surface 96 as shown in FIGS. 14 and 15. When the operator decides to launch the beads and primes the blaster 150, the pressure distributor moves and the beads are captured by the chamber while the launch spring is compressed and latched. The pressure distributor moves rearward along the rod and the array of barrels moves along the rod 114 to seal the chamber. When the trigger is pulled, the launch spring is unlatched and slams the pistons forward causing high-pressure air to propel all five beads simultaneously out of the toy blaster 10.

In the case of the blaster 150 and the blaster 280 the hydrated super absorbent polymer beads fall directly from the hopper to a chamber where the beads are aligned with a corresponding barrel.

The present invention also includes a method for making a toy launching apparatus that discharges multiple hydrated super absorbent polymer beads simultaneously including the steps of providing a housing, providing a hopper for removably mounting to the housing, the hopper for storing hydrated super absorbent polymer beads, mounting an energy source to the housing for launching multiple hydrated super absorbent polymer beads, the energy source including a single launch spring and multiple pistons and cylinders, mounting a priming handle to the housing for energizing the energy source, mounting a pressure distributor to the housing, the pressure distributor being operatively connected to the multiple cylinders, mounting an array of barrels to the housing, mounting a bead alignment system for positioning multiple hydrated super absorbent polymer beads received from the hopper with the array of barrels, and mounting a trigger to the housing and linking the trigger to the energy source for activating the energy source to launch simultaneously the multiple aligned bead rounds.

The toy launch apparatus disclosed in detail above have great play value, are fun to use and easy to operate, and are safe, even for young children, and yet the launch apparatus have robust, but simple structures, that may be produced at reasonable cost. Accordingly the toy launching apparatus for discharging multiple hydrated super absorbent polymer beads simultaneously comprise: a housing; a hopper removably mounted to the housing for storing super absorbent polymer beads; an energy source mounted to the housing for launching multiple super absorbent polymer beads, the energy source including a single launch spring and multiple pistons and cylinders; a priming handle mounted to the housing for energizing the energy source; a pressure distributor mounted to the housing, the pressure distributor being operatively connected to the multiple pistons and cylinders; an array of multiple barrels mounted to the housing; a bead alignment system mounted to the housing for positioning a predetermined multiple number of hydrated super absorbent polymer beads received from the hopper with the array of multiple barrels; and a trigger mounted to the housing and linked to the energy source for causing the energy source to launch simultaneously the predetermined multiple number of hydrated super absorbent polymer beads aligned with the array of multiple barrels.

From the foregoing, it can be seen that there has been provided features for improved toy launch apparatus and a disclosure of a method for making the toy. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launching apparatus, comprising:

a housing;

at least one barrel mounted to the housing;

a funnel in the housing for interfacing to a hopper for storing a multiplicity of projectile rounds;

an energy source at the housing for launching one or more projectile rounds of the multiplicity, the energy source including a single launch spring for moving at least one piston within one or more cylinders;

a pressure distributor operatively coupling with each of the one or more cylinders forward the at least one piston;

an alignment system for receiving a predetermined plural number of the projectile rounds of the multiplicity, for aligning individual projectile rounds of the predetermined plural number of the projectile rounds between the pressure distributor and the at least one barrel, said alignment system comprising a staging conduit for receiving the predetermined plural number of the projectile rounds, with the pressure distributor coupling each of the one or more cylinders with a respective one of the individual projectile rounds, for launching the predetermined plural number of projectile rounds; and an actuator mounted to the housing and linked to the energy source for causing the single launch spring of the energy source to move the at least one piston and launch the individual projectile rounds through the at least one barrel.

2. The toy launching apparatus of claim 1, wherein the alignment system comprises:

a staging chamber in mechanical communication with the staging conduit for aligning the individual projectile rounds between the pressure distributor and the at least one barrel, with the pressure distributor coupling each of the one or more cylinders with a respective one of the individual projectile rounds.

3. The toy launching apparatus of claim 1, wherein the at least one piston comprises a plurality of pistons, and wherein the one or more cylinders comprises a plurality of cylinders, one each of the plurality of pistons being within one each of the plurality of cylinders.

4. The toy launching apparatus of claim 3, wherein the alignment system aligns the predetermined plural number of projectile rounds with the pressure distributor coupling each of the plurality of cylinders with one of the predetermined plural number of projectile rounds.

5. The toy launching apparatus of claim 4, wherein the actuator causes the single launch spring of the energy source to move the plurality of pistons at the same time to launch the individual projectile rounds of the predetermined plural number of projectile rounds.

6. The toy launching apparatus of claim 5, wherein the individual projectile rounds of the predetermined plural number of projectile rounds are launched simultaneously.

7. The toy launching apparatus of claim 1, wherein the at least one barrel comprises an array of multiple barrels.

8. The toy launching apparatus of claim 1, wherein the hopper is positioned on the housing.

9. The toy launching apparatus of claim 8, wherein the hopper is removeable from the housing and the funnel.

10. The toy launching apparatus of claim 1, comprising a priming handle mounted to the housing for energizing the energy source, wherein the actuator comprises a trigger mounted to the housing and linked to the energy source to move the at least one pistons and launch the projectile rounds.

11. The toy launching apparatus of claim 1, wherein the projectile rounds comprise hydrated super absorbent polymer beads.

12. A toy launching apparatus, comprising:

a housing;

at least one barrel mounted to the housing;

a funnel interface in the housing for receiving a predetermined plural number of projectile rounds of the multiplicity;

an energy source at the housing for launching one or more projectile rounds of the multiplicity, the energy source including a single launch spring for moving at least one piston within one or more cylinders;

a pressure distributor operatively coupling with each of the one or more cylinders forward the at least one piston;

a staging element in mechanical communication with the funnel for aligning at least one of the predetermined plural number of projectile rounds projectile rounds between the pressure distributor and the at least one barrel, with the pressure distributor coupling each of the one or more cylinders with at least one of the predetermined plural number of projectile rounds, for launching the predetermined plural number of projectile rounds; and an actuator mounted to the housing and linked to the energy source for causing the single launch spring of the energy source to move the at least one piston and launch the at least one of the predetermined plural number projectile rounds through the at least one barrel.

13. The toy launching apparatus of claim 12, comprising a priming handle mounted to the housing for energizing the energy source, wherein the actuator comprises a trigger mounted to the housing and linked to the energy source to move the at least one piston and launch the projectile rounds.

14. The toy launching apparatus of claim 12, wherein the at least one piston comprises a plurality of pistons, and wherein the one or more cylinders comprises a plurality of cylinders, one each of the plurality of pistons being within one each of the plurality of cylinders.

15. The toy launching apparatus of claim 14, wherein the pressure distributor couples each of the plurality of cylinders with at least one of the predetermined plural number of projectile rounds.

16. The toy launching apparatus of claim 15, wherein the actuator causes the single launch spring of the energy source to move the plurality of pistons to launch the predetermined plural number of projectile rounds at the same time.

17. The toy launching apparatus of claim 15, wherein the at least one barrel comprises an array of plural barrels and the predetermined plural number of projectile rounds are launched simultaneously.

18. A toy launching method, comprising:

mounting at least one barrel at a housing;

interfacing a multiplicity of projectile rounds from a hopper;

providing an energy source at the housing including a single launch spring for moving at least one piston within one or more cylinders; for launching one or more of the multiplicity of projectile rounds;

coupling a pressure distributor operative with each of the one or more cylinders forward the one or more pistons;

receiving a predetermined plural number of the projectile rounds of the multiplicity through a staging conduit;

aligning individual projectile rounds of the predetermined plural number of the projectile rounds between the pressure distributor and the at least one barrel, with a staging chamber in mechanical communication with the staging conduit for the pressure distributor coupling each of the one or more cylinders with a respective one of the individual projectile rounds, wherein the staging element aligns the predetermined plural number of projectile rounds with the pressure distributor coupling each of the plurality of cylinders with one of the predetermined plural number of projectile rounds, and launching the predetermined plural number of projectile rounds; and actuating the energy source for causing the single launch spring of the energy source to move the one or more pistons and launch the individual projectile rounds through the at least one barrel.

19. The toy launching method of claim 18, mounting an array of plural barrels at a housing, a plurality of pistons, and a plurality of cylinders, one each of the plurality of pistons being within one each of the plurality of cylinders.

20. The toy launching method of claim 19, comprising causing the single launch spring of the energy source to move the plurality of pistons at the same time to launch the predetermined plural number of projectile rounds simultaneously.

* * * * *